US007145526B2

(12) United States Patent
Takagi et al.

(10) Patent No.: US 7,145,526 B2
(45) Date of Patent: Dec. 5, 2006

(54) DRIVING CIRCUIT OF PLASMA DISPLAY PANEL AND PLASMA DISPLAY PANEL

(75) Inventors: Akihiro Takagi, Kawasaki (JP); Takashi Shiizaki, Kawasaki (JP); Takayuki Shimizu, Kawasaki (JP); Noriaki Setoguchi, Kawasaki (JP); Hitoshi Hirakawa, Kawasaki (JP); Tomokatsu Kishi, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 409 days.

(21) Appl. No.: 10/440,319

(22) Filed: May 19, 2003

(65) Prior Publication Data

US 2004/0012546 A1 Jan. 22, 2004

(30) Foreign Application Priority Data

Jul. 22, 2002 (JP) ..... 2002-212803

(51) Int. Cl.
*G09G 3/28* (2006.01)

(52) U.S. Cl. ..... 345/63; 345/67; 345/68

(58) Field of Classification Search ..... 345/60, 345/62, 63–68; 313/484–48, 491
See application file for complete search history.

(56) References Cited

U.S. PATENT DOCUMENTS 5,446,344 A * 8/1995 Kanazawa ..... 315/169.4
5,453,660 A * 9/1995 Martin et al. ..... 313/582
5,907,311 A * 5/1999 Yano ..... 345/4
6,373,452 B1 4/2002 Ishii et al.

FOREIGN PATENT DOCUMENTS

EP 1 065 650 A2 1/2001

* cited by examiner

*Primary Examiner*—Dennis-Doon Chow
(74) *Attorney, Agent, or Firm*—Staas & Halsey LLP

(57) ABSTRACT

A driving circuit of a plasma display panel is provided in which a display cell including a first electrode and a second electrode is selected to light up, for applying a first voltage Vs1 to the first electrode and a second voltage Vs2 to the second electrode adjacent to the first electrode to cause a sustain discharge between the first and second electrodes. The driving circuit generates a sustain discharge voltage such that, during the sustain discharge between the first and second electrodes, an applied voltage Vc to a third electrode adjacent to the first electrode opposite to the second electrode falls within a range Vs2≦Vc<Vs1, and, in this case, when a display cell including the third electrode is selected to light up, the polarity of a wall charge formed on the third electrode becomes positive.

18 Claims, 27 Drawing Sheets

DRIVING CIRCUIT OF PLASMA DISPLAY PANEL AND PLASMA DISPLAY PANEL

CROSS-REFERENCE TO RELATED APPLICATIONS

This application is based upon and claims the benefit of priority from the prior Japanese Patent Application No. 2002-212803, filed on Jul. 22, 2002, the entire contents of which are incorporated herein by reference.

BACKGROUND OF THE INVENTION

1. Field of the Invention

The present invention relates to a driving circuit of a plasma display panel and a plasma display panel.

2. Description of the Related Art

FIG. 25 is a diagram showing the basic configuration of a plasma display device. A control circuit section 1101 controls an address driver 1102, a sustain electrode (X electrode) sustain (sustain discharge) circuit 1103, a scan electrode (Y electrode) sustain circuit 1104, and a scan driver 1105.

The address driver 1102 supplies a predetermined voltage to address electrodes A1, A2, A3, . . . . Hereafter, each of the address electrodes A1, A2, A3, . . . or their generic name is an address electrode Aj, j representing a suffix.

The scan driver 1105 supplies a predetermined voltage to scan electrodes Y1, Y2, Y3, . . . in accordance with control of the control circuit section 1101 and the scan electrode sustain circuit 1104. Hereafter, each of the scan electrodes Y1, Y2, Y3, . . . or their generic name is a scan electrode Yi, i representing a suffix.

The sustain electrode sustain circuit 1103 supplies the same voltage to sustain electrodes X1, X2, X3, . . . respectively. Hereafter, each of the sustain electrodes X1, X2, X3, . . . or their generic name is a sustain electrode Xi, i representing a suffix. The sustain electrodes Xi are connected to each other and have the same voltage level.

Within a display region 1107, the scan electrodes Yi and the sustain electrodes Xi form rows extending in parallel in the horizontal direction, and the address electrodes Aj form columns extending in the vertical direction. The scan electrodes Yi and the sustain electrodes Xi are alternately arranged in the vertical direction. Ribs 1106 have a stripe rib structure provided between the address electrodes Aj.

The scan electrodes Yi and the address electrodes Aj form a two-dimensional matrix with i rows and j columns. A display cell Cij is formed of an intersection of the scan electrode Yi and the address electrode Aj and the sustain electrode Xi correspondingly adjacent thereto. This display cell Cij corresponds to a pixel, so that the display region 1107 can display a two-dimensional image.

FIG. 26A is a view showing the configuration of a cross section of the display cell Cij in FIG. 25. The sustain electrode Xi and the scan electrode Yi are formed on a front glass substrate 1211. A dielectric layer 1212 for insulating the electrodes from a discharge space 1217 is applied thereover, and a MgO (magnesium oxide) protective film 1213 is further applied over the dielectric layer 1212.

On the other hand, the address electrode Aj is formed on a rear glass substrate 1214 which is disposed to oppose the front glass substrate 1211, a dielectric layer 1215 is applied thereover, and further phosphors are applied over the dielectric layer 1215. In the discharge space 1217 between the MgO protective film 1213 and the dielectric layer 1215, a Ne+Xe Penning gas or the like is sealed.

FIG. 26B is a view for explaining a capacitance Cp of an AC drive type plasma display. A capacitance Ca is a capacitance of the discharge space 1217 between the sustain electrode Xi and the scan electrode Yi. A capacitance Cb is a capacitance of the dielectric layer 1212 between the sustain electrode Xi and the scan electrode Yi. A capacitance Cc is a capacitance of the front glass substrate 1211 between the sustain electrode Xi and the scan electrode Yi. The sum of the capacitances Ca, Cb, and Cc determines the capacitance between the electrodes Xi and Yi.

FIG. 26C is a view for explaining light emission of the AC drive type plasma display. On an inner surface of a rib 1216, phosphors 1218 in red, blue and green are applied, arranged in stripes for each color, so that a discharge between the sustain electrode Xi and the scan electrode Yi excites the phosphors 1218 to generate light 1221.

FIG. 27 is a diagram of the configuration of one frame FR of an image. The image is formed of, for example, 60 frames per second. One frame FR is formed of a first subframe SF1, a second subframe SF2, . . . , and an nth subframe SFn. This n is, for example, 10, and corresponds to the number of grayscale bits. Each of the subframes SF1, SF2, and so on or their generic name is a subframe SF hereafter.

Each subframe SF is composed of a reset period Tr, an address period Ta, and a sustain period (sustain discharge period) Ts. During the rest period Tr, the display cell is initialized. During the address period Ta, lighting or non-lighting of each display cell can be selected by addressing. The selected cell emits light during the sustain period Ts. The number of light emissions (period of time) is different in each SF. This can determine a grayscale value.

FIG. 28 shows a driving method during the sustain period Ts of a progressive method plasma display according to the prior art. At time t1, an anode potential Vs1 is applied to the sustain electrodes Xn−1, Xn, and Xn+1, and a cathode potential Vs2 is applied to the scan electrodes Yn−1, Yn, and Yn+1. This applies a high voltage respectively between the sustain electrode Xn−1 and the scan electrode Yn−1, between the sustain electrode Xn and the scan electrode Yn, and between the sustain electrode Xn+1 and the scan electrode Yn+1 to perform sustain discharges 1410.

Subsequently, at time t2, the cathode potential Vs2 is applied to the sustain electrodes Xn−1, Xn, and Xn+1, and the anode potential Vs1 is applied to the scan electrodes Yn−1, Yn, and Yn+1. This applies a high voltage respectively between the sustain electrode Xn−1 and the scan electrode Yn−1, between the sustain electrode Xn and the scan electrode Yn, and between the sustain electrode Xn+1 and the scan electrode Yn+1 to perform sustain discharges 1410.

Subsequently, at time t3, the same potentials as those at time t1 are applied to perform sustain discharges 1410, and at time t4, the same potentials as those at time t2 are applied to perform sustain discharges 1410.

FIG. 29 shows a driving method during the sustain period Ts of a plasma display by an ALIS (Alternate Lighting of Surfaces) method according to the prior art. At time t1, the anode potential Vs1 is applied to the sustain electrodes Xn−1 and Xn+1 on odd-numbered rows, and the cathode potential Vs2 is applied to the scan electrodes Yn−1 and Yn+1 on odd-numbered rows. Further, the cathode potential Vs2 is applied to the sustain electrode Xn on an even-numbered row, and the anode potential Vs1 is applied to the scan electrode Yn on an even-numbered row. This applies a high voltage respectively between the sustain electrode Xn−1 and the scan electrode Yn−1, between the sustain electrode Xn and the scan electrode Yn, and between the sustain electrode Xn+1 and the scan electrode Yn+1 to perform sustain discharges 1510.

Subsequently, at time t2, the cathode potential Vs2 is applied to the sustain electrodes Xn−1 and Xn+1 on the odd-numbered rows, and the anode potential Vs1 is applied to the scan electrodes Yn−1 and Yn+1 on the odd-numbered rows. Further, the anode potential Vs1 is applied to the sustain electrode Xn on the even-numbered row, and the cathode potential Vs2 is applied to the scan electrode Yn on the even-numbered row. This applies a high voltage respectively between the sustain electrode Xn−1 and the scan electrode Yn−1, between the sustain electrode Xn and the scan electrode Yn, and between the sustain electrode Xn+1 and the scan electrode Yn+1 to perform sustain discharges 1510.

Subsequently, at time t3, the same potentials as those at time t1 are applied to perform sustain discharges 1510, and at time t4, the same potentials as those at time t2 are applied to perform sustain discharges 1510.

With an increase in resolution of plasma displays, the distance between adjacent electrodes decreases. This results in shortened distances from the sustain electrode Xn and the scan electrode Yn constituting the discharge space to the scan electrode Yn−1 and the sustain electrode Xn+1 arranged adjacent thereto, respectively.

Therefore, when a discharge is caused between the sustain electrode Xn and the scan electrode Yn, electrons on the scan electrode Yn−1 or the sustain electrode Xn+1 are likely to diffuse (transfer) to cause an adjacent display cell constituted of the sustain electrode Xn−1 and the scan electrode Yn−1 or the sustain electrode Xn+1 and the scan electrode Yn+1 to perform error display such that the display cell lights up during time when the display cell should turn off, or the display cell turns off during time when the display cell should light up because the electrodes cannot sustain a discharge.

SUMMARY OF THE INVENTION

It is an object of the present invention to provide a driving circuit of a plasma display panel capable of performing a stable sustain discharge by reducing effects by adjacent display cells, and a plasma display panel.

According to an aspect of the present invention, a driving circuit of a plasma display panel is provided in which a display cell including a first electrode and a second electrode is selected to light up, for applying a first voltage Vs1 to the first electrode and a second voltage Vs2 to the second electrode adjacent to the first electrode to cause a sustain discharge between the first and second electrodes. The driving circuit generates a sustain discharge voltage such that, during the sustain discharge between the first and second electrodes, an applied voltage Vc to a third electrode adjacent to the first electrode opposite to the second electrode falls within a range $Vs2 \leqq Vc < Vs1$, and, in this case, when a display cell including the third electrode is selected to light up, the polarity of a wall charge formed on the third electrode becomes positive.

According to another aspect of the present invention, a plasma display panel is provided which comprises: a plurality of electrode pairs for performing sustain discharges arranged in parallel to each other; a plurality of address electrodes arranged to intersect the electrode pairs; and display cells defined by intersections of the electrode pairs and the address electrodes, the plasma display panel having an address period for selecting lighting or non-lighting of each of the display cells and a sustain discharge period, subsequent to the address period, for performing a discharge for light emission for display at each of the display cells and, during the sustain discharge period, performing at different timings the discharges for light emission of even-numbered electrode pairs and odd-numbered electrode pairs of the plurality of electrode pairs for performing display during the sustain discharge period.

During performance of the sustain discharges between the first and second display electrodes, the applied voltage to the third electrodes adjacent to the first and second electrodes performing the sustain discharge and the polarity of the wall charges formed on the third electrodes are controlled, thereby preventing the charges on the first and second electrodes from diffusing to the adjacent electrodes to eliminate error display.

DETAILED DESCRIPTION OF THE PREFERRED EMBODIMENTS

First Embodiment

Figure 1:
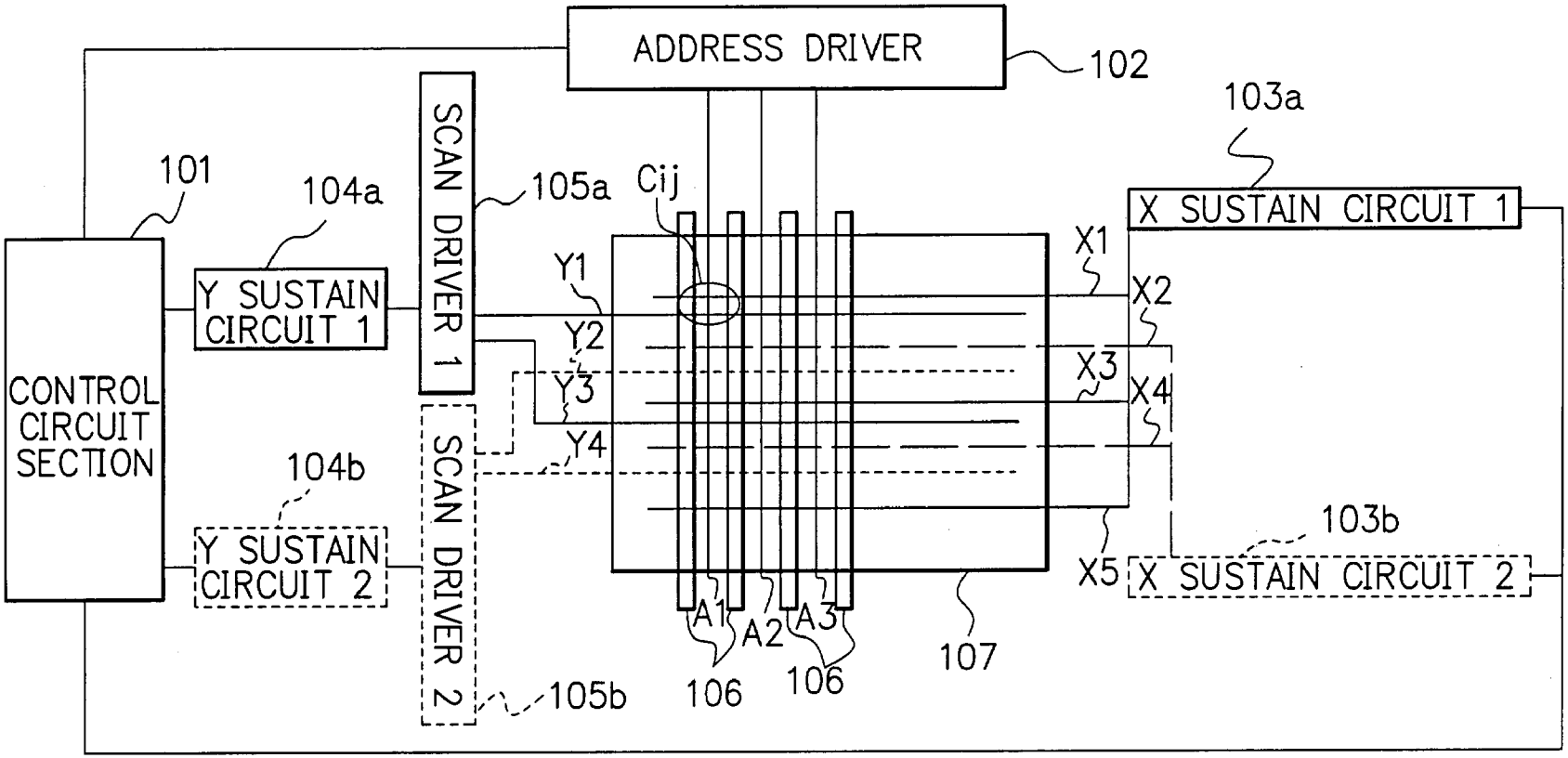
FIG. 1 is a diagram showing the configuration of a plasma display device according to a first embodiment of the present invention.

FIG. 1 is a diagram showing the configuration of a plasma display device according to a first embodiment of the present invention. A control circuit section 101 controls an address driver 102, sustain electrode (X electrode) sustain circuits 103*a* and 103*b*, scan electrode (Y electrode) sustain circuits 104*a* and 104*b*, and scan drivers 105*a* and 105*b*.

The address driver 102 supplies a predetermined voltage to address electrodes A1, A2, A3, . . . . Hereafter, each of the address electrodes A1, A2, A3, . . . or their generic name is an address electrode Aj, j representing a suffix.

The first scan driver 105*a* supplies a predetermined voltage to scan electrodes (first discharge electrodes) Y1, Y3, . . . on odd-numbered rows in accordance with control of the control circuit section 101 and the first scan electrode sustain circuit 104*a*. The second scan driver 105*b* supplies a predetermined voltage to scan electrodes Y2, Y4, . . . on even-numbered rows in accordance with control of the control circuit section 101 and the second scan electrode sustain circuit 104*b*. Hereafter, each of the scan electrodes Y1, Y2, Y3, . . . or their generic name is a scan electrode Yi, i representing a suffix.

The first sustain electrode sustain circuit 103*a* supplies the same voltage to sustain electrodes (second discharge electrodes) X1, X3, . . . on odd-numbered rows, respectively. The second sustain electrode sustain circuit 103*b* supplies the same voltage to sustain electrodes X2, X4, . . . on even-numbered rows, respectively. Hereafter, each of the sustain electrodes X1, X2, X3, . . . or their generic name is a scan electrode Xi, i representing a suffix.

Within a display region 107, the scan electrodes Yi and the sustain electrodes Xi form rows extending in parallel in the horizontal direction, and the address electrodes Aj form columns extending in the vertical direction. The scan electrodes Yi and the sustain electrodes Xi are alternately arranged in the vertical direction. Ribs 106 have a stripe rib structure provided between the address electrodes Aj.

Figure 26A:
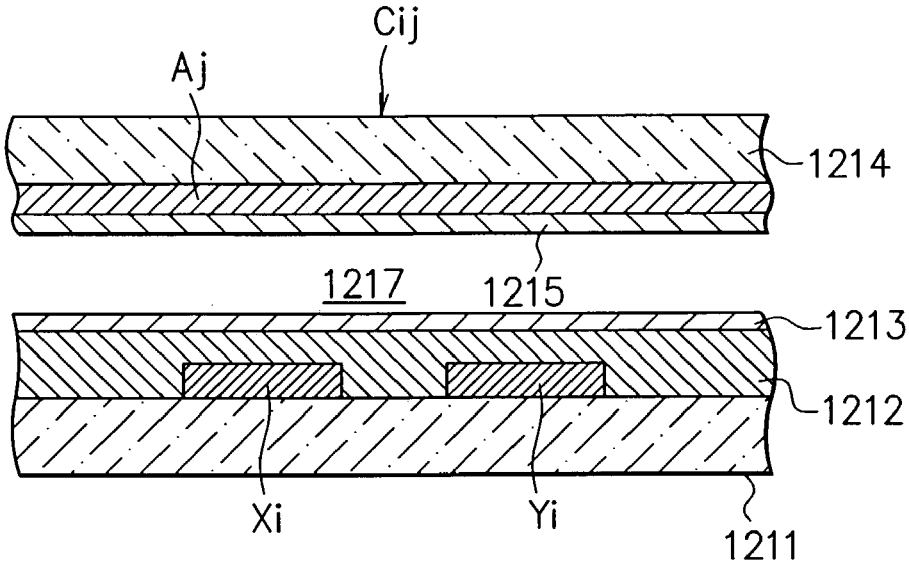
FIGS. 26A to 26C are cross-sectional views of a display cell of a plasma display.
Figure 26B:
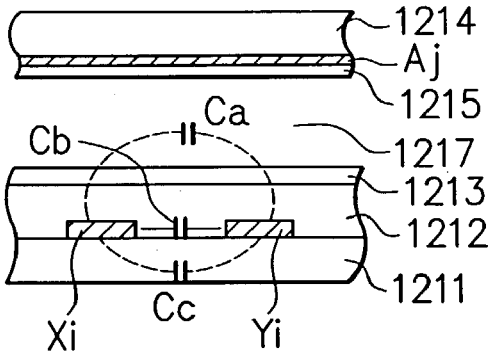
Figure 26C:
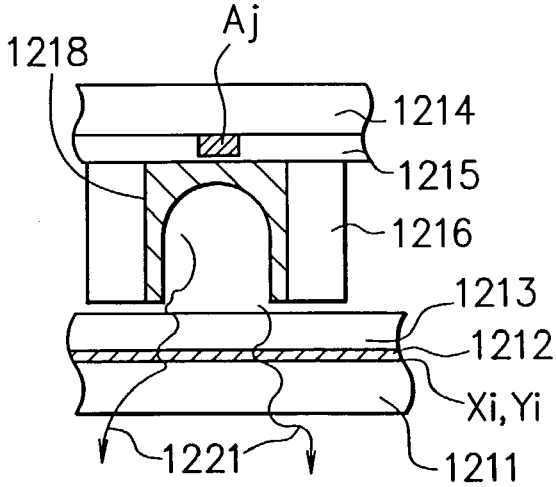

The scan electrodes Yi and the address electrodes Aj form a two-dimensional matrix with i rows and j columns. A display cell Cij is formed of an intersection of the scan electrode Yi and the address electrode Aj and the sustain electrode Xi correspondingly adjacent thereto. This display cell Cij corresponds to a pixel, so that the display region 107 can display a two-dimensional image. The configuration of the display cell Cij is the same as that in the above-described FIGS. 26A to 26C.

Figure 2:
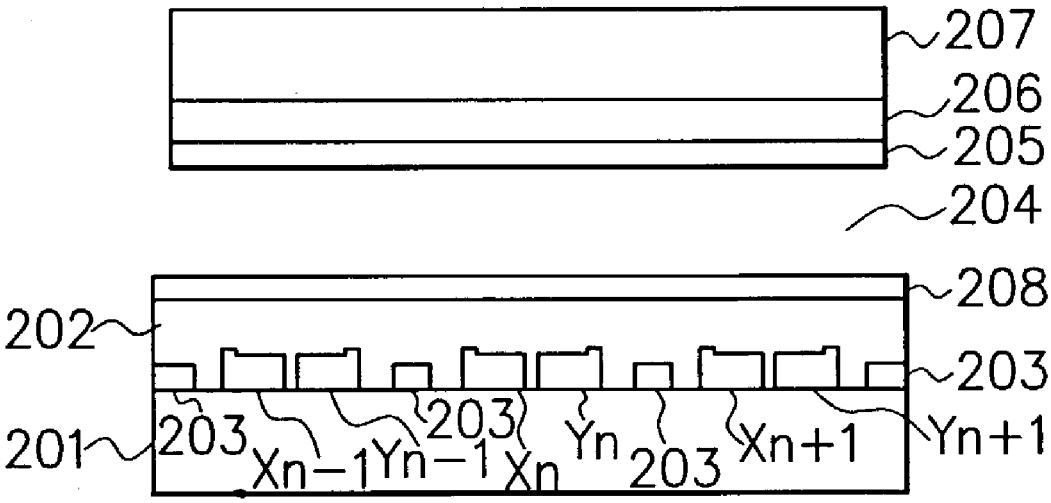
FIG. 2 is a cross-sectional view of a progressive method plasma display.

FIG. 2 is a cross-sectional view of a progressive method plasma display. On a glass substrate 201, a display cell of a sustain electrode Xn−1 and a scan electrode Yn−1, a display cell of a sustain electrode Xn and a scan electrode Yn, a display cell of a sustain electrode Xn+1 and a scan electrode Yn+1, and so on are formed. Between the display cells, light shields 203 are provided. A dielectric layer 202 is provided to cover the light shields 203 and the electrodes Xi and Yi. A protective film 208 is provided on the dielectric layer 202.

Under a glass substrate 207, an address electrode 206 and a dielectric layer 205 are provided. A discharge space 204 is provided between the protective film 208 and the dielectric layer 205 and has a Ne+Xe Penning gas or the like sealed therein. Discharged light in the display cell is reflected by the phosphor 1218 (FIG. 26C) and passes through the glass substrate 201 for display.

In the progressive method, the interval between the electrodes Xn−1 and Yn−1, the interval between the electrodes Xn and Yn, and the interval between the electrodes Xn+1 and Yn+1, being the respective pairs of electrodes constituting the display cells, are small, so that discharges can be performed. Besides, the interval between the electrodes Yn−1 and Xn and the interval between the electrodes Yn and Xn+1, the intervals existing between different display cells, are large, so that discharge is not performed. In other words, each electrode can perform a sustain discharge only with the adjacent electrode on one side thereof.

Figure 27:
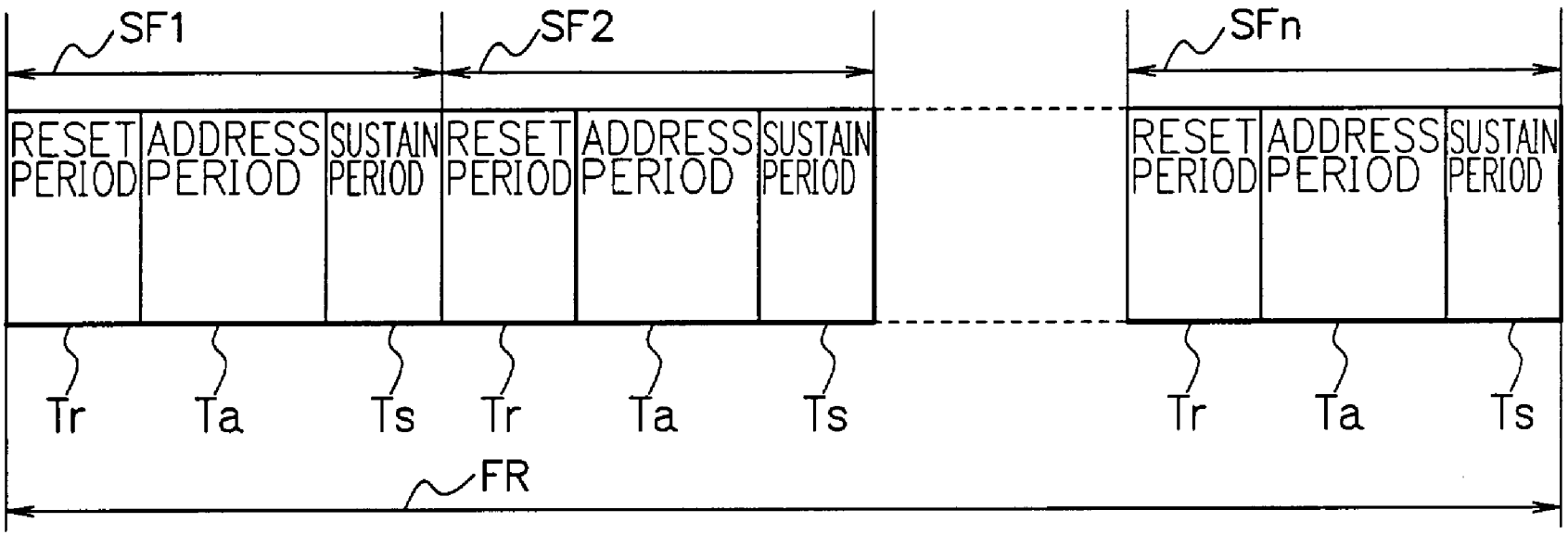
FIG. 27 is a diagram of the configuration of a frame of an image.
Figure 28:
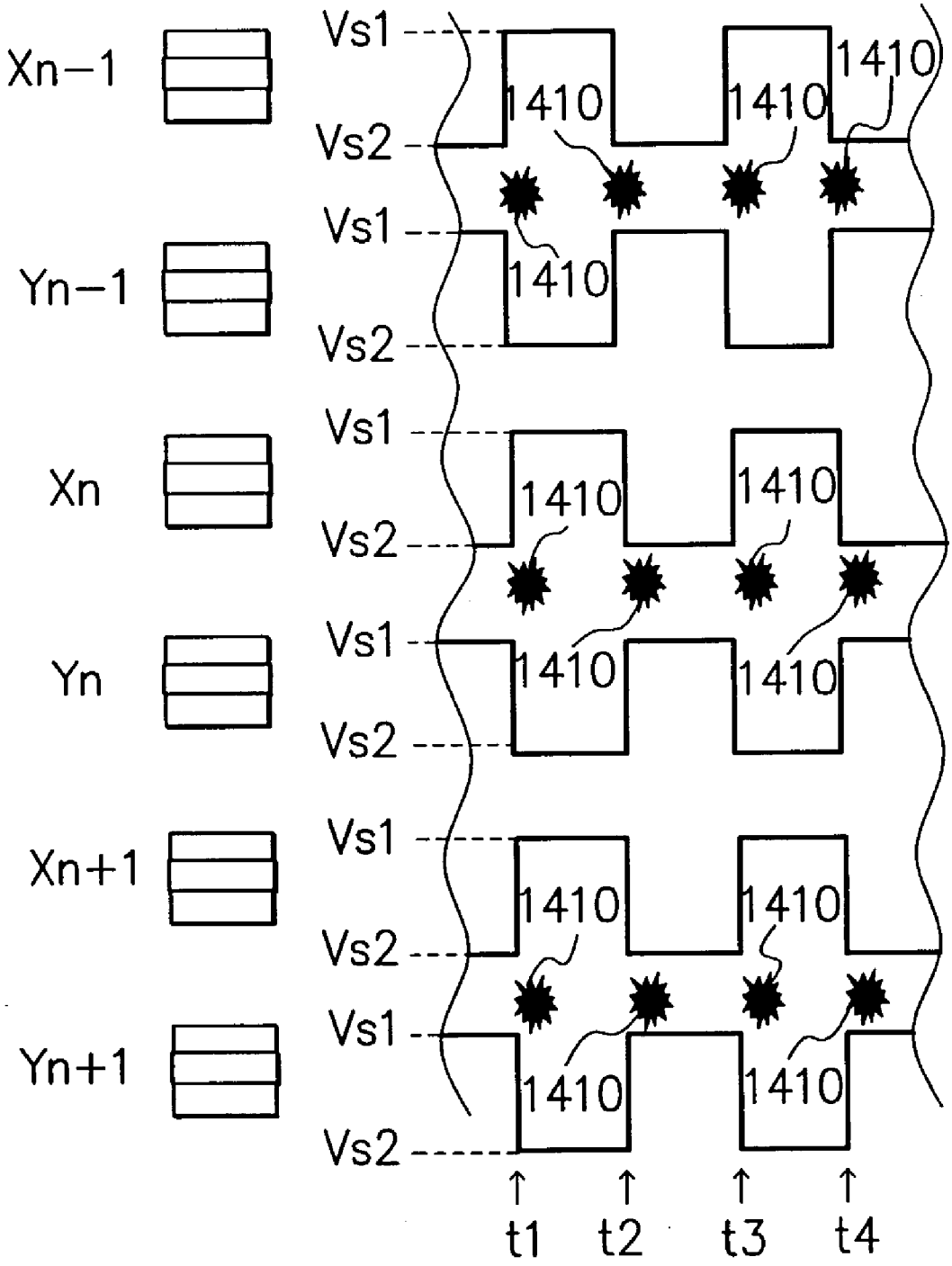
F I G. 28 PRIOR ART
FIG. 28 is a diagram showing waveforms during a sustain period of a progressive method plasma display according to the prior art.
Figure 29:
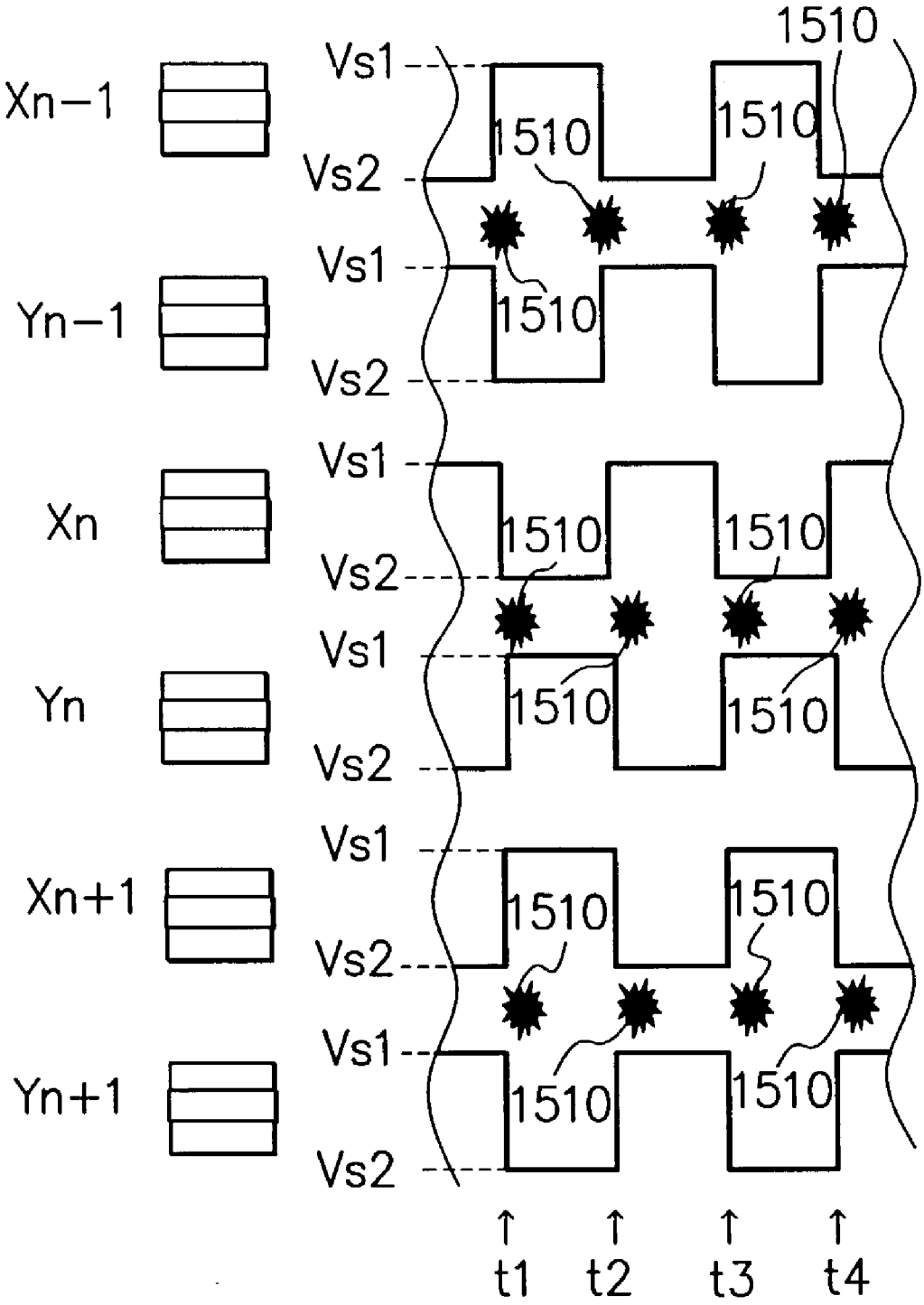
F I G. 29 PRIOR ART
FIG. 29 is a diagram showing waveforms during a sustain period of an ALIS method plasma display according to the prior art.

The frame of an image displayed by the plasma display is the same as that in the aforementioned FIG. 27. In FIG. 27, first, during the reset period Tr, a predetermined voltage is applied between the scan electrodes Yi and the sustain electrodes Xi to perform a total write and a total erase of charges, thereby erasing previous display contents and forming predetermined wall charges.

Then, during the address period Ta, a pulse at a positive potential (lighting selection voltage) is applied to the address electrode Aj and a pulse at a cathode potential Vs2 is applied to a desired scan electrode Yi by a sequential scan. These pulses cause an address discharge between the address electrode Aj and the scan electrode Yi to address a display cell (select for lighting).

Subsequently, during the sustain period (sustain discharge period) Ts, a predetermined voltage is applied between the sustain electrodes Xi and the scan electrodes Yi to perform a sustain discharge between the sustain electrode Xi and the scan electrode Yi which correspond to the display cell addressed during the address period Ta for light emission.

Figure 3:
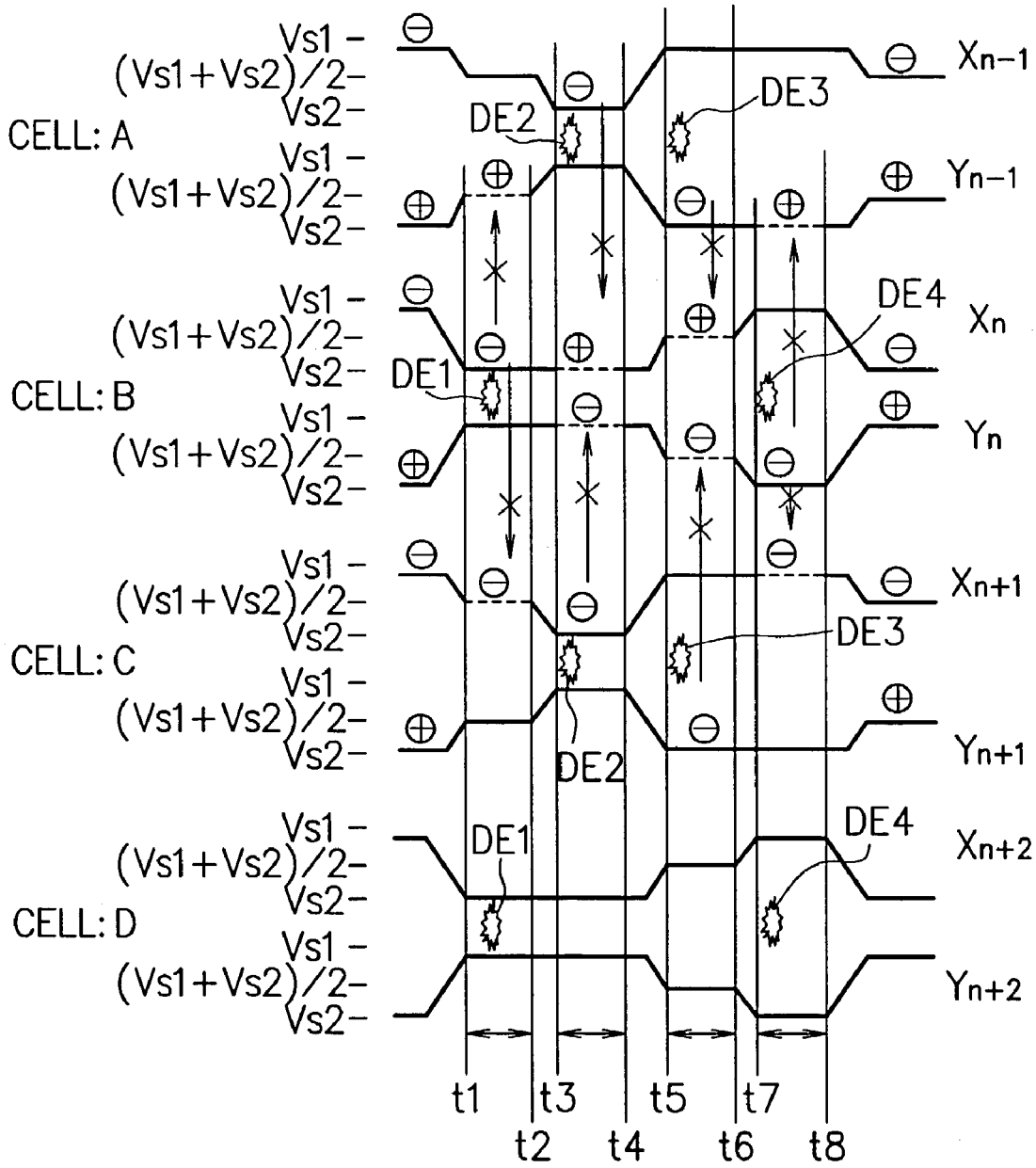
FIG. 3 is a timing chart showing a driving method during a sustain period of the progressive method plasma display according to the first embodiment.

FIG. 3 is a timing chart showing a driving method during the sustain period Ts of the progressive method plasma display. The electrodes Xn−1, Yn−1, Xn, Yn, Xn+1, Yn+1, Xn+2, Yn+2, and so on are provided in sequence in order.

First, from time t1 to time t2, first discharges DE1 are performed between the electrodes Xn and Yn and between electrodes Xn+2 and Yn+2. Subsequently, from time t3 to time t4, second discharges DE2 are performed between the electrodes Xn−1 and Yn−1 and between the electrodes Xn+1 and Yn+1. Subsequently, from time t5 to time t6, third discharges DE3 are performed between the electrodes Xn−1 and Yn−1 and between the electrodes Xn+1 and Yn+1. Subsequently, from time t7 to time t8, fourth discharges DE4 are performed between the electrodes Xn and Yn and between the electrodes Xn+2 and Yn+2. The sustain discharges are repeated with the first to fourth discharges DE1 to DE4 as one cycle. This can prevent negative charges (electrons) during the discharges from diffusing to adjacent electrodes.

Here, the same voltage is applied to the sustain electrodes Xn−1, Xn+1, and the like on the odd-numbered rows, the same voltage is applied to the sustain electrodes Xn, Xn+2, and the like on the even-numbered rows, the same voltage is applied to the scan electrodes Yn−1, Yn+1, and the like on the odd-numbered rows, and the same voltage is applied to the scan electrodes Yn, Yn+2, and the like on the even-numbered rows.

During the sustain period Ts, even-numbered electrode pairs and odd-numbered electrode pairs, out of electrode pairs of a plurality of display cells which perform display during the sustain period Ts, perform discharges for light emission at different timings. For example, the odd-numbered electrode pairs perform the discharges DE1 and DE4, and, at a timing different therefrom, the even-numbered electrode pairs perform the discharges DE2 and DE3.

Further, the discharge for light emission of one pair of the even-numbered electrode pair and the odd-numbered electrode pair is performed first and then the discharge for light emission of the other pair is performed. In this event, the applied voltages to the one electrode pair are sustained from the start of the discharge for light emission between the one electrode pair to the end of the discharge for light emission between the other electrode pair.

First Discharge

Figure 4A:
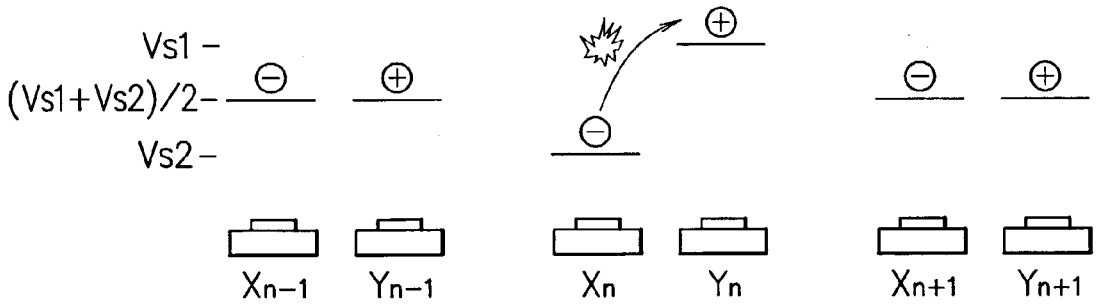
FIGS. 4A to 4C are diagrams showing applied voltages to electrodes during a first discharge.
Figure 4B:
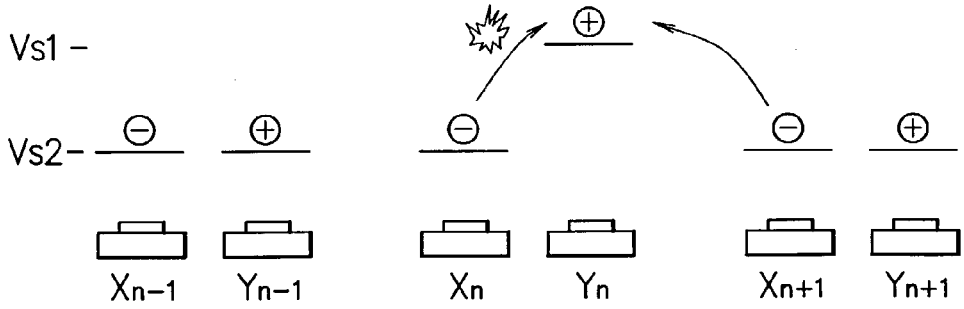
Figure 4C:
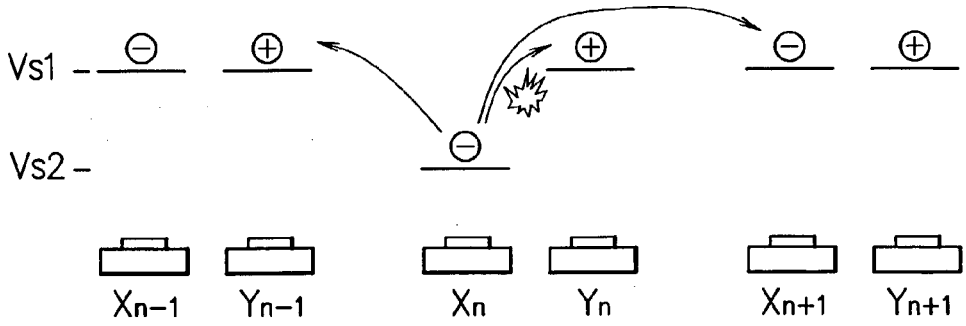

FIGS. 4A to 4C are diagrams for explaining conditions of the first discharge DE1 in FIG. 3. The display cell of the electrodes Xn and Yn is addressed (selected to light up) during the address period Ta (FIG. 27), the cathode voltage Vs2 is applied to the electrode Xn, and the anode voltage Vs1 is applied to the electrode Yn during the sustain period Ts (FIG. 27), thereby causing a discharge between the electrodes Xn and Yn. In this event, if the display cell of the electrodes Xn−1 and Yn−1 is addressed, positive wall charges are formed on the adjacent electrode Yn−1, and if the display cell of the electrodes Xn+1 and Yn+1 is addressed, negative wall charges are formed on the adjacent electrode Xn+1. The same voltage is applied to the sustain electrodes Xn−1 and Xn+1 on the odd-numbered rows, and the same voltage is applied to the scan electrodes Yn−1 and Yn+1 on the odd-numbered rows.

FIG. 4A is a diagram showing the voltages to the adjacent electrodes Yn−1 and Xn+1 set to (Vs1+Vs2)/2 when a discharge is caused between the electrodes Xn and Yn. In this case, the wall charges on the electrodes Xn and Yn never diffuse to the adjacent electrodes Yn−1 and Xn+1, thereby preventing error display.

FIG. 4B is a diagram showing the voltages to the adjacent electrodes Yn−1 and Xn+1 set to the cathode voltage Vs2 when a discharge is caused between the electrodes Xn and Yn. In this case, the negative wall charges on the adjacent electrode Xn+1 diffuse onto the electrode Yn. Therefore, the adjacent electrode Xn+1 needs to have a voltage higher than the cathode voltage Vs2. On the other hand, the wall charges on the electrodes Xn and Yn never diffuse onto the electrode Yn−1. Therefore, the adjacent electrode Yn−1 only needs to have a voltage equal to or higher than the cathode voltage Vs2.

FIG. 4C is a diagram showing the voltages to the adjacent electrodes Yn−1 and Xn+1 set to the anode voltage Vs1 when a discharge is caused between the electrodes Xn and Yn. In this case, the negative wall charges on the adjacent electrode Xn diffuse onto the adjacent electrode Yn−1. Therefore, the adjacent electrode Yn−1 needs to have a voltage lower than the anode voltage Vs1. On the other hand, when the negative charges exist on the electrode Xn+1, the negative wall charges on the electrode Xn never diffuse over the electrode Yn onto the electrode Xn+1. However, if the display cell of the electrodes Xn+1 and Yn+1 is not addressed, no wall charge exists on the electrodes Xn+1 and Yn+1. In this case, the negative wall charges on the electrode Xn diffuse over the electrode Yn onto the electrode Xn+1. This may cause, the display cell of the electrodes Xn+1 and Yn+1 to light up in error later. Therefore, the adjacent electrode Xn+1 needs to have a voltage lower than the anode voltage Vs1.

Similarly, in FIG. 4B, if the display cell of the electrodes Xn−1 and Yn−1 is not addressed, no wall charge exists on the electrodes Xn−1 and Yn−1. Also in this case, it can be reasoned that the positive wall charges on the electrode Yn diffuse over the electrode Xn onto the electrode Yn−1. Actually, however, the positive wall charges are larger in mass than the negative wall charges, and thus are hard to diffuse as compared to the negative wall charges. Therefore, in FIG. 4B, the positive wall charges on the electrode Yn never diffuse over the electrode Xn onto the electrode Yn−1.

The foregoing conditions will be explained together. When the cathode voltage Vs2 is applied to the electrode Xn, and the anode voltage Vs1 is applied to the electrode Yn to cause a discharge between the electrodes Xn and Yn, an applied voltage Vyn−1 to the adjacent electrode Yn−1 only needs to be set within the following range. For example, in FIG. 3, the voltage Vyn−1=(Vs1+Vs2)/2.

$$Vs2 \leqq Vyn-1 < Vs1$$

Further, an applied voltage Vxn+1 to the adjacent electrode Xn+1 only needs to be set within the following range. For example, in FIG. 3, the voltage Vxn+1=(Vs1+Vs2)/2.

$$Vs2 < Vxn+1 < Vs1$$

As described above, in this event, when lighting is caused by sustain (sustain discharge) between the adjacent electrodes Xn−1 and Yn−1, the polarity of the wall charges on the electrode Yn−1, generated by the previous sustain between the electrodes Xn−1 and Yn−1, becomes positive. Similarly, when lighting is caused by sustain between the adjacent electrodes Xn+1 and Yn+1, the polarity of the wall charges on the electrode Xn+1, generated by the previous sustain between the electrodes Xn+1 and Yn+1, becomes negative. Such sustain discharge voltage prevents the negative wall charges on the electrode Xn from diffusing to the electrode Yn−1 or the electrode Xn+1.

Second Discharge

Figure 5A:
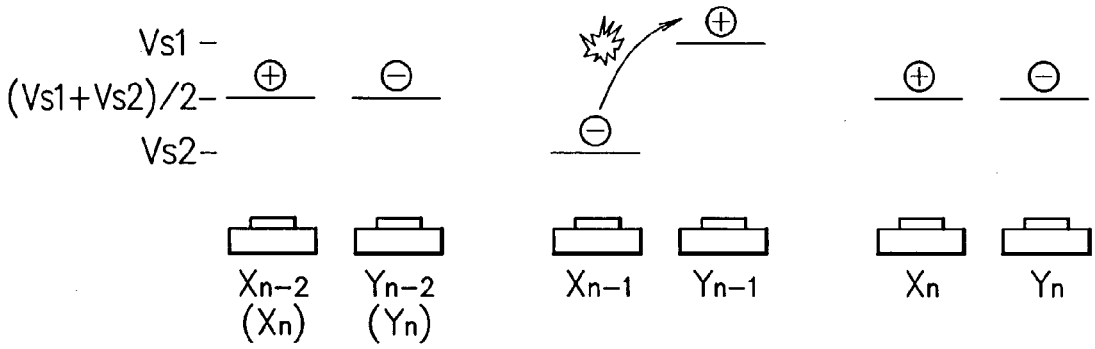
FIGS. 5A to 5C are diagrams showing applied voltages to electrodes during a second discharge.
Figure 5B:
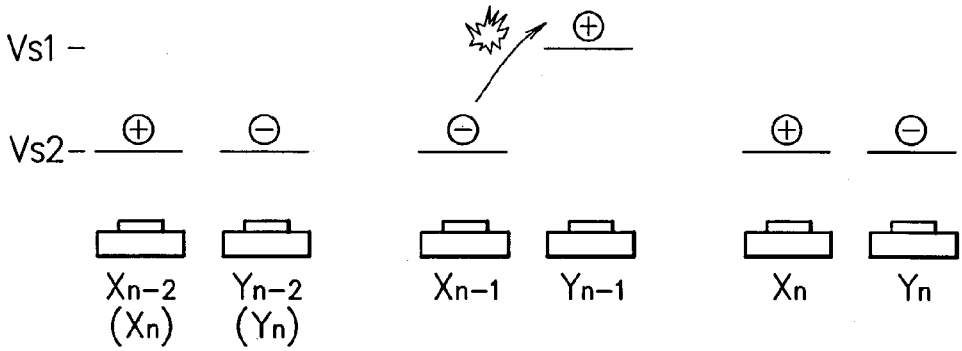
Figure 5C:
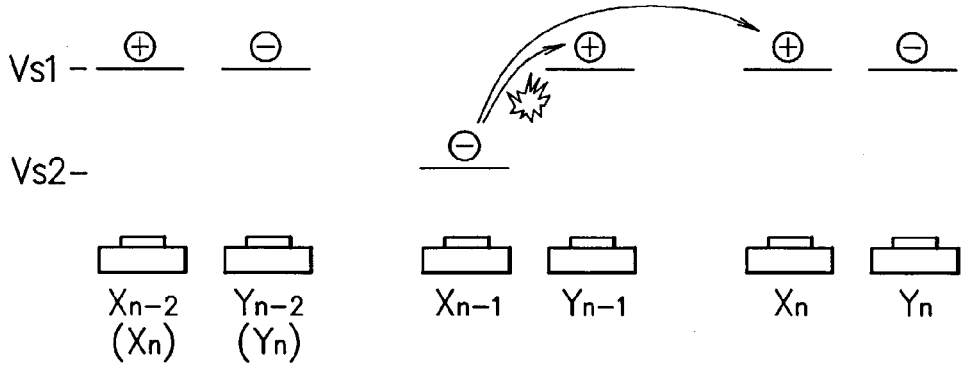

FIGS. 5A to 5C are diagrams for explaining conditions of the second discharge DE2 in FIG. 3. The display cell of the electrodes Xn−1 and Yn−1 is addressed (selected to light up) during the address period Ta (FIG. 27), the cathode voltage Vs2 is applied to the electrode Xn−1, and the anode voltage Vs1 is applied to the electrode Yn−1 during the sustain period Ts (FIG. 27), thereby causing a discharge between the electrodes Xn−1 and Yn−1. In this event, if the display cell of the electrodes Xn−2 and Yn−2 is addressed, negative wall charges are formed on the electrode Yn−2, and if the display cell of the electrodes Xn and Yn is addressed, positive wall charges are formed on the electrode Xn. The same voltage is applied to the sustain electrodes Xn−2 and Xn on the even-numbered rows, and the same voltage is applied to the scan electrodes Yn−2 and Yn on the even-numbered rows.

FIG. 5A is a diagram showing the voltages to the adjacent electrodes Yn−2 and Xn set to (Vs1+Vs2)/2 when a discharge is caused between the electrodes Xn−1 and Yn−1. In this case, the wall charges on the electrodes Xn−1 and Yn−1 never diffuse to the adjacent electrodes Yn−2 and Xn, thereby preventing error display.

FIG. 5B is a diagram showing the voltages to the adjacent electrodes Yn−2 and Xn set to the cathode voltage Vs2 when a discharge is caused between the electrodes Xn−1 and Yn−1. In this case, the charges on the electrodes Xn−1 and Yn−1 never diffuse onto the electrode Xn. Note that since positive wall charges are formed both on the electrodes Yn−1 and Xn, no charge transfers between the electrodes Yn−1 and Xn. Besides, even when the display cell of the electrodes Xn and Yn is not addressed and thus no wall charge exists on the electrodes Xn and Yn, the positive wall charges on the electrode Yn−1 never diffuse onto the electrode Xn. In this event, no negative charge exists on the electrode Xn. Therefore, the adjacent electrode Xn only needs to have a voltage equal to or higher than the cathode voltage Vs2. On the other hand, the charges on the electrodes Xn−1 and Yn−1 never diffuse to the adjacent electrode Yn−2. Note that the positive wall charges on the electrode Yn−1 are larger in mass than the negative wall charges, and thus never diffuse over the electrode Xn−1 onto the electrode Yn−2. Therefore, the adjacent electrode Yn−2 only needs to have a voltage equal to or higher than the cathode voltage Vs2.

FIG. 5C is a diagram showing the voltages to the adjacent electrodes Yn−2 and Xn set to the anode voltage Vs1 when a discharge is caused between the electrodes Xn−1 and Yn−1. In this case, the charges on the electrodes Xn−1 and Yn−1 never diffuse onto the adjacent electrode Yn−2. Note that since negative wall charges are formed both on the electrodes Xn−1 and Yn−2, no charge transfers between the electrodes Xn−1 and Yn−2. Besides, even when the display cell of the electrodes Xn−2 and Yn−2 is not addressed and thus no wall charge exists on the electrodes Xn−2 and Yn−2, the negative wall charges on the electrode Xn−1 never diffuse onto the electrodes Yn−2. Therefore, the adjacent electrode Yn−2 needs to have a voltage equal to or lower than the anode voltage Vs1. On the other hand, since the electrodes Yn−1 and Xn are at the same potential, the negative wall charges on the electrode Xn−1 diffuse to the electrodes Yn−1 and the electrode Xn adjacent thereto. In this event, if the positive wall charges exist or do not exist on the electrode Xn in response to the addressing of the display cell of the electrodes Xn and Yn, the negative wall charges on the electrode Xn−1 diffuse onto the electrode Xn. Therefore, the adjacent electrode Xn needs to have a voltage lower than the anode voltage Vs1.

The foregoing conditions will be explained together. When the cathode voltage Vs2 is applied to the electrode Xn−1, and the anode voltage Vs1 is applied to the electrode Yn−1 to cause a discharge between the electrodes Xn−1 and Yn−1, an applied voltage Vxn to the electrode Xn only needs to be set within the following range. For example, in FIG. 3, the voltage Vxn=Vs2.

$$Vs2 \leqq Vxn < Vs1$$

Similarly, when the cathode voltage Vs2 is applied to the electrode Xn−1, and the anode voltage Vs1 is applied to the electrode Yn−1 to cause a discharge between the electrodes Xn−1 and Yn−1, an applied voltage Vyn to the electrode Yn−2 (Yn) only needs to be set within the following range. For example, in FIG. 3, the voltage Vyn=Vs1.

$$Vs2 \leqq Vyn \leqq Vs1$$

In this event, when lighting is caused by sustain (sustain discharge) between the electrodes Xn and Yn, the polarity of the wall charges on the electrode Xn, generated by the previous sustain between the electrodes Xn and Yn, becomes positive, and the polarity of the wall charges on the electrode Yn becomes negative. This prevents the negative wall charges on the electrode Xn−1 from diffusing to the electrode Xn or Yn−2.

Third Discharge

Figure 6A:
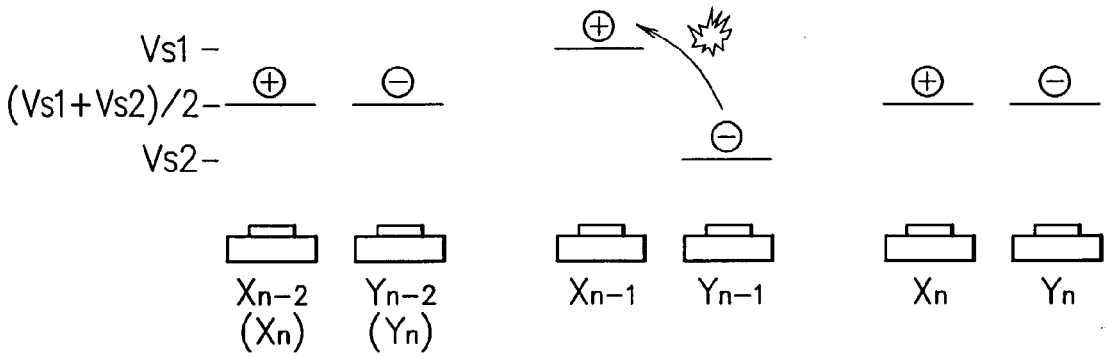
FIGS. 6A to 6C are diagrams showing applied voltages to electrodes during a third discharge.
Figure 6B:
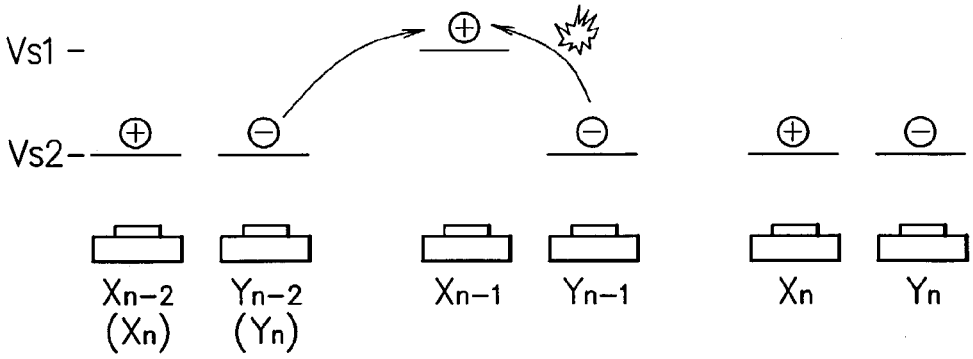
Figure 6C:
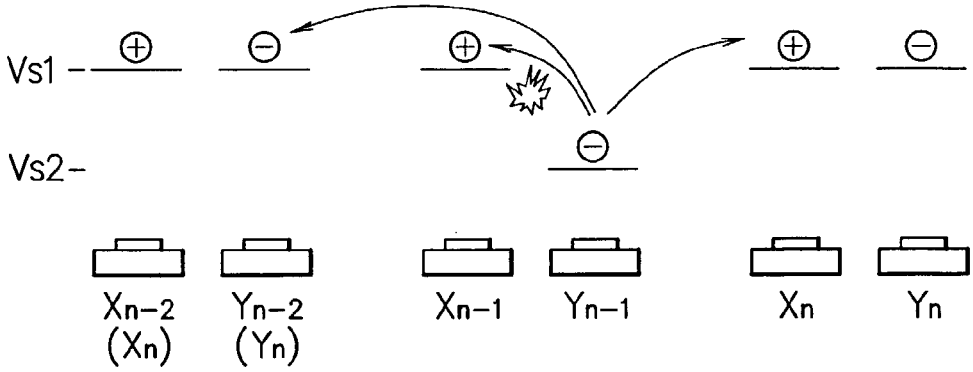

FIGS. 6A to 6C are diagrams for explaining conditions of the third discharge DE3 in FIG. 3. The display cell of the electrode Xn−1 and the electrode Yn−1 is addressed (selected to light up) during the address period Ta (FIG. 27), the anode voltage Vs1 is applied to the electrode Xn−1, and the cathode voltage Vs2 is applied to the electrode Yn−1 during the sustain period Ts (FIG. 27), thereby causing a discharge between the electrodes Xn−1 and Yn−1. In this event, if the display cell of the electrodes Xn−2 and Yn−2 is addressed, negative wall charges are formed on the electrode Yn−2, and if the display cell of the electrodes Xn and Yn is addressed, positive wall charges are formed on the electrode Xn. The same voltage is applied to the sustain electrodes Xn−2 and Xn on the even-numbered rows, and the same voltage is applied to the scan electrodes Yn−2 and Yn on the even-numbered rows.

FIG. 6A is a diagram showing the voltages to the adjacent electrodes Yn−2 and Xn set to (Vs1+Vs2)/2 when a discharge is caused between the electrodes Xn−1 and Yn−1. In this case, the wall charges on the electrodes Xn−1 and Yn−1 never diffuse to the adjacent electrodes Yn−2 or Xn, thereby preventing error display.

FIG. 6B is a diagram showing the voltages to the adjacent electrodes Yn−2 and Xn set to the cathode voltage Vs2 when a discharge is caused between the electrodes Xn−1 and Yn−1. In this case, the charges on the electrodes Xn−1 and Yn−1 never diffuse onto the electrode Xn. Note that the positive wall charges on the electrode Xn−1 are larger in mass than the negative wall charges, and thus never diffuse over the electrode Yn−1 onto the electrode Xn. Therefore, the adjacent electrode Xn only needs to have a voltage equal to or higher than the cathode voltage Vs2. On the other hand, the negative wall charges on the electrode Yn−2 diffuse to the electrodes Xn−1. Therefore, the adjacent electrode Yn−2 needs to have a voltage higher than the cathode voltage Vs2.

FIG. 6C is a diagram showing the voltages to the adjacent electrodes Yn−2 and Xn set to the anode voltage Vs1 when a discharge is caused between the electrodes Xn−1 and Yn−1. In this case, the negative wall charges on the electrodes Yn−1 diffuse onto the adjacent electrode Xn. Therefore, the adjacent electrode Xn needs to have a voltage lower than the anode voltage Vs1. On the other hand, if negative charges exist on the electrode Yn−2, the negative wall charges on the electrode Yn−1 never diffuse over the electrode Xn−1 onto the electrode Yn−2. However, if the display cell of the electrodes Xn−2 and Yn−2 is not addressed, and thus no wall charge exists on the electrodes Xn−2 and Yn−2, the negative wall charges on the electrode Yn−1 diffuse over the electrode Xn−1 onto the electrode Yn−2. This may cause the display cell of the electrodes Xn−2 and Yn−2 to light up in error later. Therefore, the adjacent electrode Yn−2 needs to have a voltage lower than the anode voltage Vs1.

The foregoing conditions will be explained together. When the anode voltage Vs1 is applied to the electrode Xn−1 and the cathode voltage Vs2 is applied to the electrode Yn−1 to cause a discharge between the electrodes Xn−1 and Yn−1, an applied voltage Vxn to the adjacent electrode Xn only needs to be set within the following range. For example, in FIG. 3, the voltage Vxn=(Vs1+Vs2)/2.

$$Vs2 \leqq Vxn < Vs1$$

Similarly, when the anode voltage Vs1 is applied to the electrode Xn−1, and the cathode voltage Vs2 is applied to the electrode Yn−1 to cause a discharge between the electrodes Xn−1 and Yn−1, an applied voltage Vyn to the electrode Yn−2 (Yn) only needs to be set within the following range. For example, in FIG. 3, the voltage Vyn=(Vs1+Vs2)/2.

$$Vs2 < Vyn < Vs1$$

In this event, when lighting is caused by sustain (sustain discharge) between the electrodes Xn and Yn, the polarity of the wall charges on the electrode Xn, generated by the previous sustain between the electrodes Xn and Yn, becomes positive, and the polarity of the wall charges on the electrode Yn becomes negative. This prevents the negative wall charges on the electrode Yn−1 from diffusing to the electrode Xn or Yn−2.

Fourth Discharge

Figure 7A:
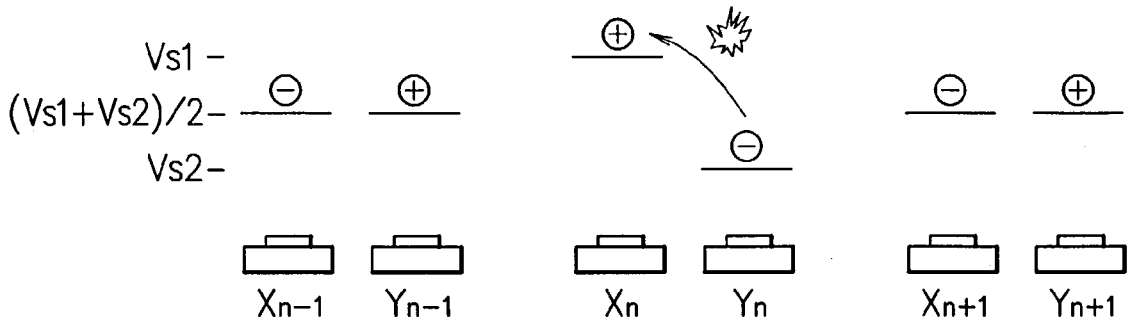
FIGS. 7A to 7C are diagrams showing applied voltages to electrodes during a fourth discharge.
Figure 7B:
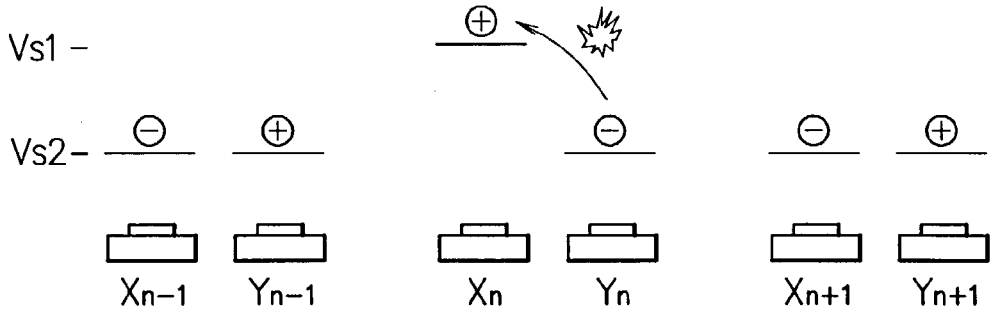
Figure 7C:
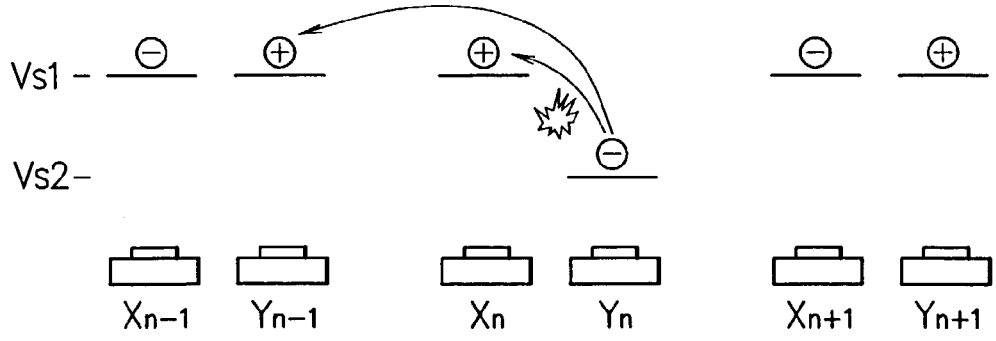

FIGS. 7A to 7C are diagrams for explaining conditions of the fourth discharge DE4 in FIG. 3. The display cell of the electrodes Xn and Yn is addressed (selected to light up) during the address period Ta (FIG. 27), the anode voltage Vs1 is applied to the electrode Xn, and the cathode voltage Vs2 is applied to the electrode Yn during the sustain period Ts (FIG. 27), thereby causing a discharge between the electrodes Xn and Yn. In this event, if the display cell of the electrodes Xn−1 and Yn−1 is addressed, positive wall charges are formed on the adjacent electrode Yn−1, and if the display cell of the electrodes Xn+1 and Yn+1 is addressed, negative wall charges are formed on the adjacent electrode Xn+1.

FIG. 7A is a diagram showing the voltages to the adjacent electrodes Yn−1 and Xn+1 set to (Vs1+Vs2)/2 when a discharge is caused between the electrodes Xn and Yn. In this case, the wall charges on the electrodes Xn and Yn never diffuse to the adjacent electrodes Yn−1 or Xn+1, thereby preventing error display.

FIG. 7B is a diagram showing the voltages to the adjacent electrodes Yn−1 and Xn+1 set to the cathode voltage Vs2 when a discharge is caused between the electrodes Xn and Yn. In this case, the charges on the electrodes Xn and Yn never diffuse onto the electrode Xn+1. Note that the positive wall charges on the electrode Xn are larger in mass than the negative wall charges, and thus never diffuse over the electrode Yn onto the electrode Xn+1. Therefore, the adjacent electrode Xn+1 only needs to have a voltage equal to or higher than the cathode voltage Vs2. On the other hand, the charges on the electrodes Xn and Yn never diffuse onto the electrode Yn−1. Note that since the polarity of the wall charges on the electrode Yn−1 is positive, no charge transfers between the electrodes Xn and Yn−1. Besides, even when the display cell of the electrodes Xn−1 and Yn−1 is not addressed, and thus no wall charge exists on the electrodes Xn−1 and Yn−1, the positive wall charges on the electrode Xn never diffuse onto the electrode Yn−1. In this event, no negative wall charge exists on the electrode Yn−1. Therefore, the adjacent electrode Yn−1 only needs to have a voltage equal to or higher than the cathode voltage Vs2.

FIG. 7C is a diagram showing the voltages to the adjacent electrodes Yn−1 and Xn+1 set to the anode voltage Vs1 when a discharge is caused between the electrodes Xn and Yn. In this case, the charges on the electrodes Yn and Xn never diffuse onto the adjacent electrode Xn+1. Note that since the polarity of the wall charges on the electrode Xn+1 is negative, no charge transfers between the electrodes Yn and Xn+1. Besides, even when the display cell of the electrodes Xn+1 and Yn+1 is not addressed, and thus no wall charge exists on the electrodes Xn+1 and Yn+1, the negative wall charges on the electrode Yn never diffuse onto the electrode Xn+1. In this event, no positive wall charge exists on the electrode Xn+1. Therefore, the adjacent electrode Xn+1 only needs to have a voltage equal to or lower than the anode voltage Vs1. On the other hand, the negative charges on the electrode Yn diffuse over the electrode Xn to the electrode Yn−1. In this event, if the positive wall charges exist or do not exist on the electrode Yn−1 in response to the addressing of the display cell of the electrodes Xn−1 and Yn−1, the negative wall charges on the electrode Yn diffuse over the electrode Xn onto the electrode Yn−1. Therefore, the adjacent electrode Yn−1 needs to have a voltage lower than the anode voltage Vs1.

The foregoing conditions will be explained together. When the anode voltage Vs1 is applied to the electrode Xn, and the cathode voltage Vs2 is applied to the electrode Yn to cause a discharge between the electrodes Xn and Yn, an applied voltage Vyn−1 to the electrode Yn−1 only needs to be set within the following range. For example, in FIG. 3, the voltage Vyn−1=Vs2.

$$Vs2 \leqq Vyn-1 < Vs1$$

Besides, an applied voltage Vxn+1 to the electrode Xn+1 only needs to be set within the following range. For example, in FIG. 3, the voltage Vxn+1=Vs1.

$$Vs2 \leqq Vxn+1 \leqq Vs1$$

In this event, when lighting is caused by sustain (sustain discharge) between the electrodes Xn−1 and Yn−1 adjacent to the electrodes Xn and Yn, the polarity of the wall charges on the electrode Yn−1, generated by the previous sustain between the electrodes Xn−1 and Yn−1, becomes positive. Similarly, when lighting is caused by sustain between the electrodes Xn+1 and Yn+1 adjacent to the electrodes Xn and Yn, the polarity of the wall charges on the electrode Xn+1, generated by the previous sustain between the electrodes Xn+1 and Yn+1, becomes negative. Such voltage waveforms of sustain discharges prevent the negative wall charges on the electrode Yn from diffusing to the electrode Yn−1 or Xn+1.

Second Embodiment

Figure 8:
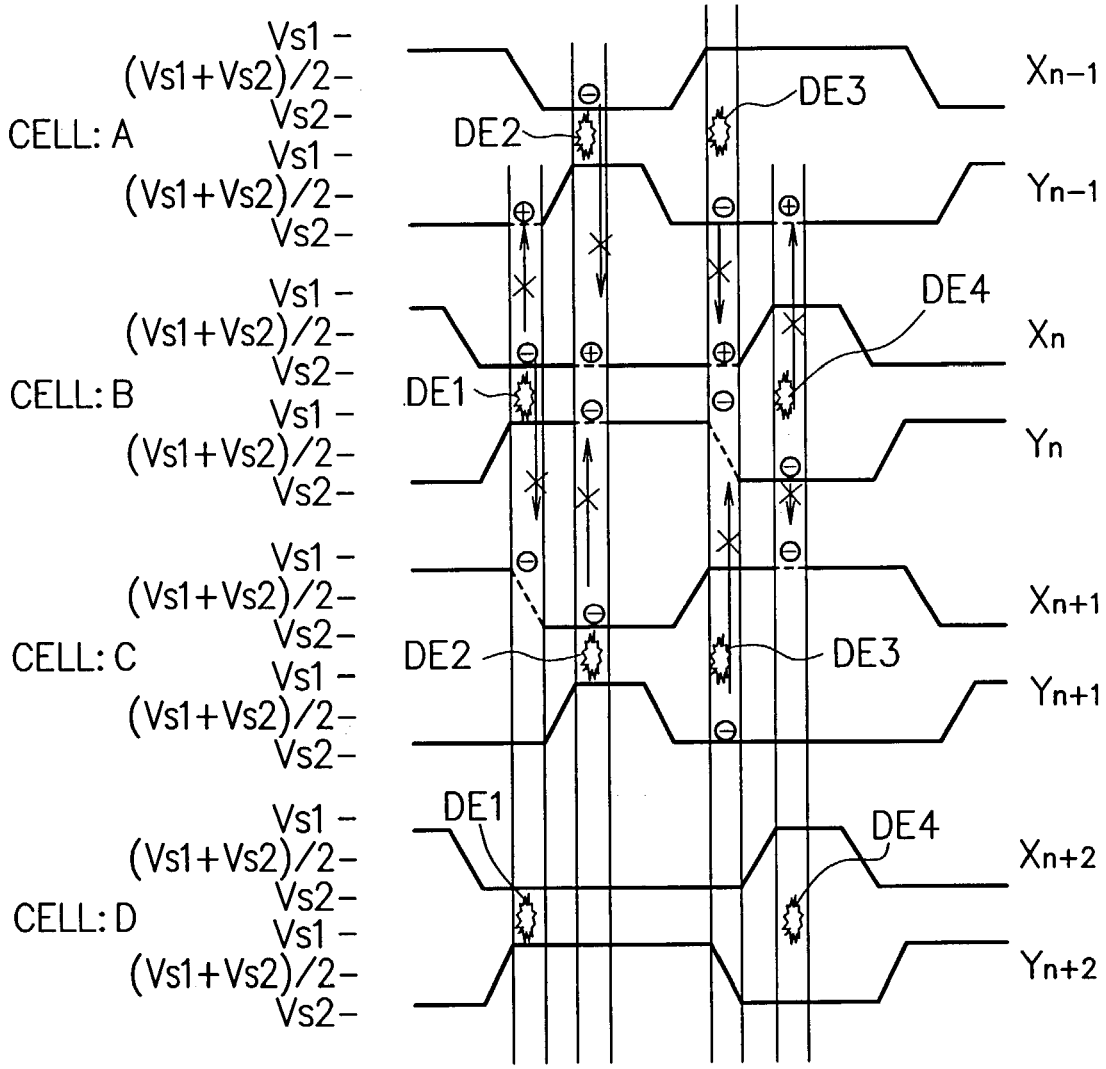
FIG. 8 is a timing chart showing a driving method during a sustain period of a progressive method plasma display according to a second embodiment of the present invention.

FIG. 8 is a timing chart showing a driving method during the sustain period Ts of a progressive method plasma display according to a second embodiment of the present invention. The voltage waveforms of sustain discharges in FIG. 8 are basically the same as those in FIG. 3, and thus the following description will be made on different points.

As for the first discharge DE1, the cathode voltage Vs2 is applied to the electrode Xn, and the anode voltage Vs1 is applied to the electrode Yn, thereby causing a discharge between the electrodes Xn and Yn. In this event, the applied voltage Vxn+1 to the adjacent electrode Xn+1 is changed within the following range.

$$Vs2<Vxn+1<Vs1$$

For example, the voltage Vxn+1 is gradually changed from the anode voltage Vs1 to the cathode voltage Vs2. This means that the applied voltage to the adjacent electrode may be changed during the discharge within the range of the conditions shown in the first embodiment. Note that, during the first discharge DE1, the adjacent electrode Yn−1 sustains the cathode voltage Vs2 as from before the first discharge DE1 in this embodiment.

As for the third discharge DE3, the anode voltage Vs1 is applied to the electrode Xn+1 and the cathode voltage Vs2 is applied to the electrode Yn+1, thereby causing a discharge between the electrodes Xn+1 and Yn+1. In this event, the applied voltage Vyn to the adjacent electrode Yn is changed within the following range.

$$Vs2<Vyn<Vs1$$

Note that, during the third discharge DE3, the adjacent electrode Xn sustains the cathode voltage Vs2 as from before the third discharge DE3 in this embodiment.

According to this embodiment, even if the applied voltage to the adjacent electrode is changed during the discharge within the range of the conditions shown in the first embodiment, the same effects as those in the first embodiment can be attained. In other words, it is possible to prevent diffusion of charges so as to eliminate error display.

Third Embodiment

Figure 9:
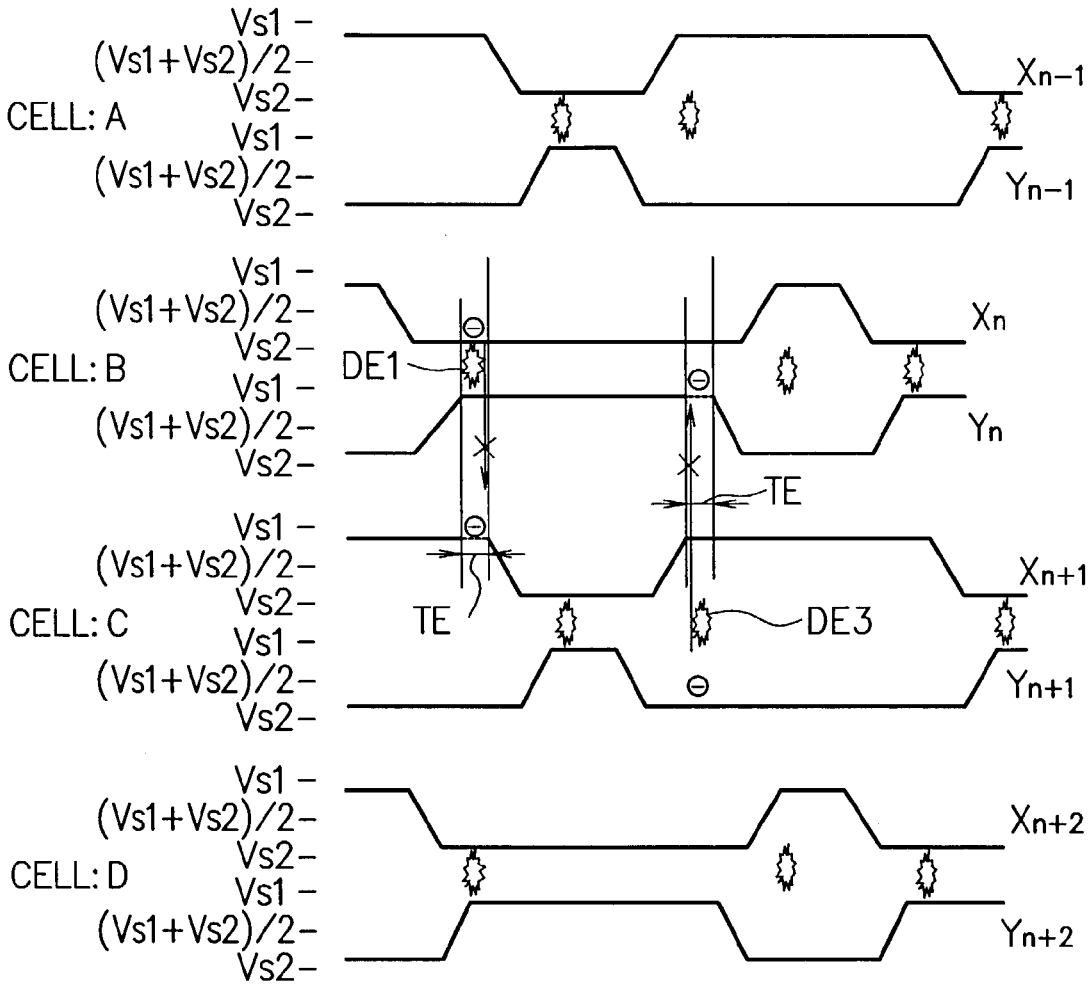
FIG. 9 is a timing chart showing a driving method during a sustain period of a progressive method plasma display according to a third embodiment of the present invention.

FIG. 9 is a timing chart showing a driving method during the sustain period Ts of a progressive method plasma display according to a third embodiment of the present invention. The voltage waveforms of sustain discharges in FIG. 9 are basically the same as those in FIG. 8, and thus the following description will be made on different points.

As for the first discharge DE1, the cathode voltage Vs2 is applied to the electrode Xn, and the anode voltage Vs1 is applied to the electrode Yn, thereby causing a discharge between the electrodes Xn and Yn. In this event, the applied voltage Vxn+1 to the adjacent electrode Xn+1 is set to Vxn+1 Vs1, exceeding the set range Vs2<Vxn+1<Vs1. In this event, however, a time TE during which Vxn+1=Vs1 is within 500 ns. For example, the time TE is 100 ns. After a lapse of the time TE, the voltage Vxn+1 is set within the range Vs2<Vxn+1<Vs1.

This applies to the third discharge DE3. During the third discharge DE3, the applied voltage Vyn to the adjacent electrode Yn is first set to Vyn=Vs1 during the time TE and then to the range Vs2<Vyn<Vs1.

According to this embodiment, within 500 ns, even if the voltage to the aforementioned adjacent electrode is Vs1, the negative charges on the electrode Xn during the period of the first discharge DE1 and the negative charges on the electrode Yn+1 during the period of the third discharge DE3 never diffuse to the electrodes Xn+1 and Yn, respectively. The reason will be described hereafter with reference to FIGS. 10A to 10C and FIGS. 11A to 11C.

Figure 10A:
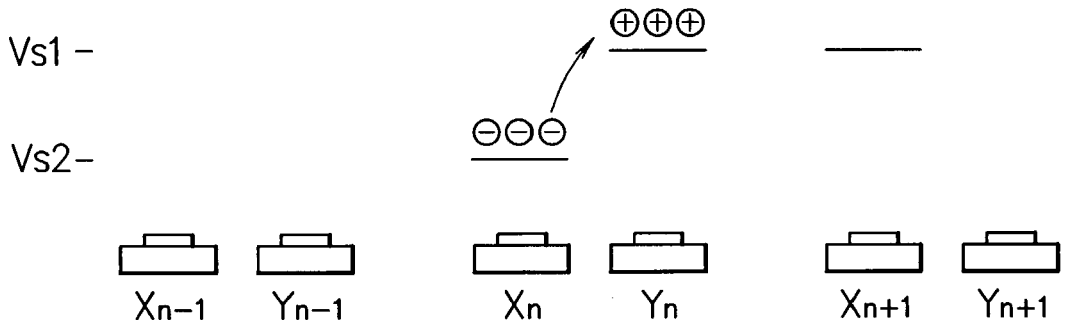
FIGS. 10A to 10C are diagrams showing a problem of applied voltages to electrodes during a first discharge in FIG. 9.
Figure 10B:
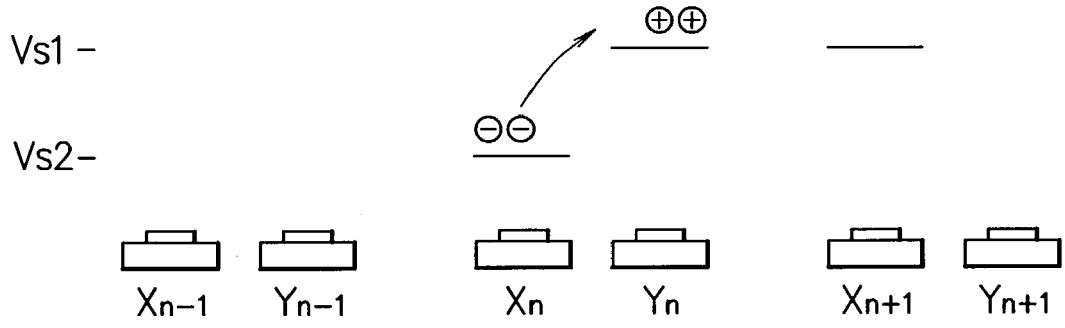
Figure 10C:
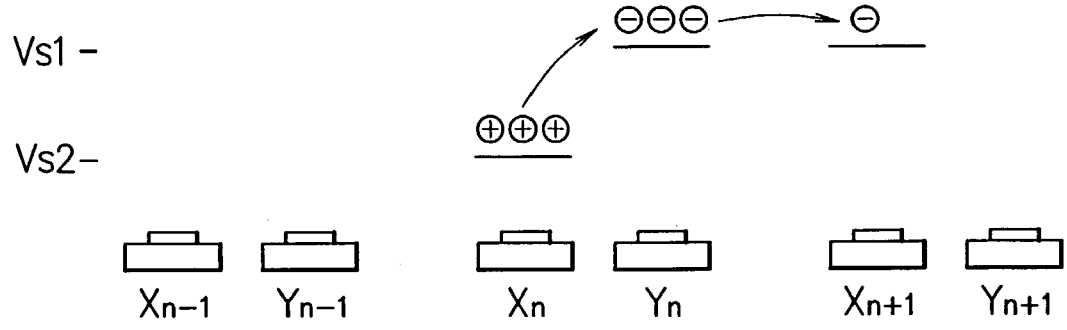

FIGS. 10A to 10C show a problem when the anode voltage Vs1 is kept applied to the adjacent electrode Xn+1 during the first discharge DE1 in FIG. 9. FIGS. 10A to 10C show the state in FIG. 4C with time transition. More specifically, the cathode voltage Vs2 is applied to the electrode Xn, the anode voltage Vs1 to the electrode Yn, and the anode voltage Vs1 to the adjacent electrode Xn+1.

In FIG. 10A, the negative charges on the electrode Xn start to transfer onto the electrode Yn due to the potential difference between the electrodes Xn and Yn. In FIG. 10B, the negative charges on the electrode Xn further transfer onto the electrode Yn. In FIG. 10C, the negative charges on the electrode Xn further transfer onto the electrode Yn to form negative charges on the electrode Yn. When a predetermined amount of negative charges are formed on the electrode Yn, the negative charges on the electrode Yn diffuse to the adjacent electrode Xn+1.

Figure 11A:
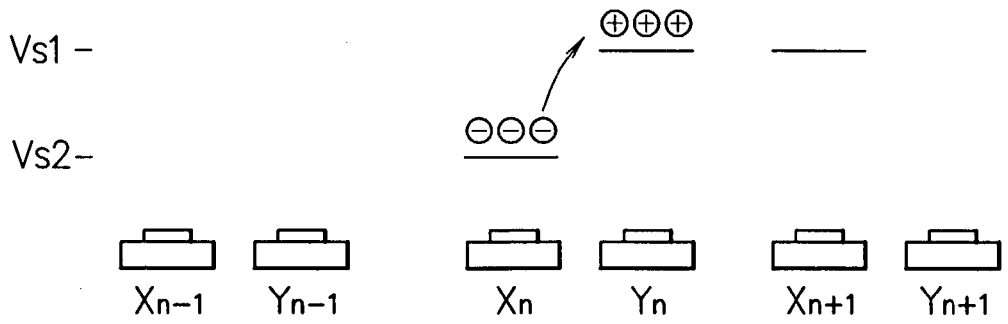
FIGS. 11A to 11C are diagrams showing applied voltages to electrodes during the first discharge in FIG. 9.
Figure 11B:
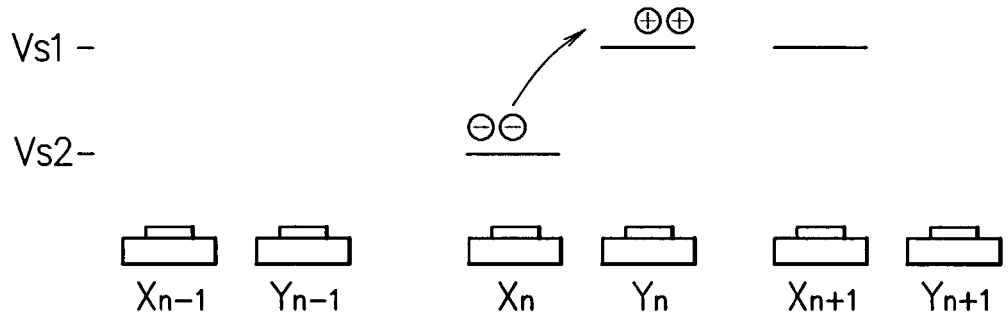
Figure 11C:
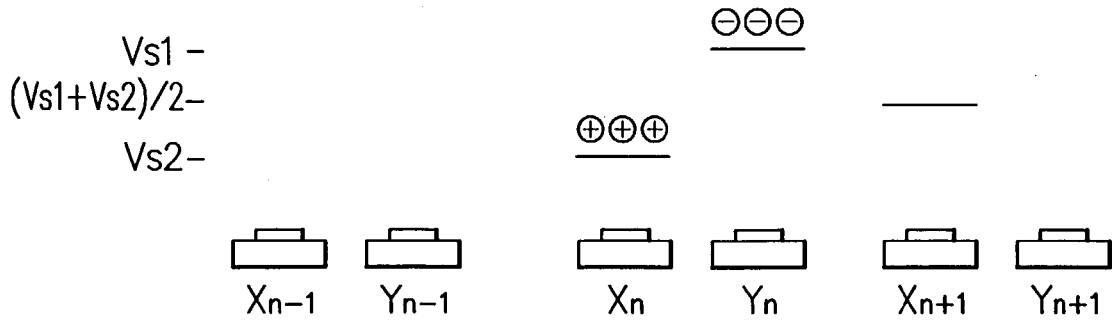

FIGS. 11A to 11C show transition of voltage to the adjacent electrode Xn+1 during the first discharge DE1 shown in FIG. 9. In FIG. 11A, the cathode voltage Vs2 is applied to the electrode Xn, the anode voltage Vs1 is applied to the electrode Yn, and the anode voltage Vs1 is applied to the adjacent electrode Xn+1. This state is sustained for the time TE (within 500 ns). Then, the negative charges on the electrode Xn transfer onto the electrode Yn as in FIG. 11B. Then, after the time TE and before a predetermined amount of negative charges are formed on the electrode Yn, as shown in FIG. 11C, the voltage Vxn+1 to the adjacent electrode Xn+1 is set within the range Vs2<Vxn+1<Vs1. For example, the voltage Vxn+1=(Vs1+Vs2)/2. This can prevent the negative charges from diffusing onto the electrode Xn+1.

Fourth Embodiment

Figure 12:
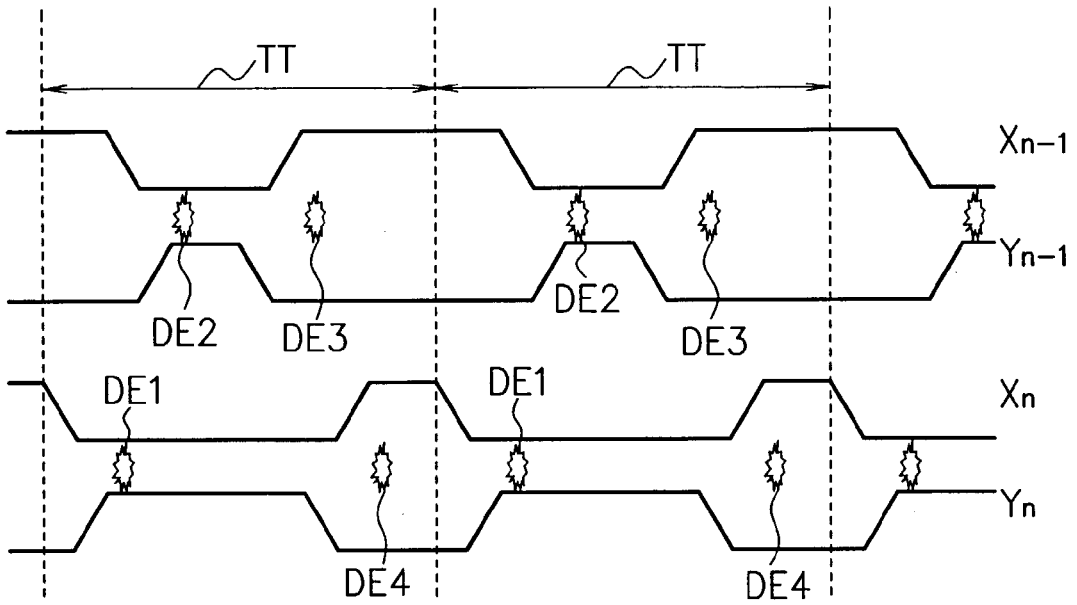
FIG. 12 is a timing chart showing a driving method during a sustain period of a progressive method plasma display according to a fourth embodiment of the present invention.

FIG. 12 is a timing chart showing a driving method during the sustain period Ts of a progressive method plasma display according to a fourth embodiment of the present invention. This embodiment shows the sustain discharge voltage waveforms of repeating the voltage waveforms during the period TT shown in the second embodiment (FIG. 8) as one cycle. The one cycle TT includes the first to fourth discharges DE1 to DE4.

Fifth Embodiment

Figure 13:
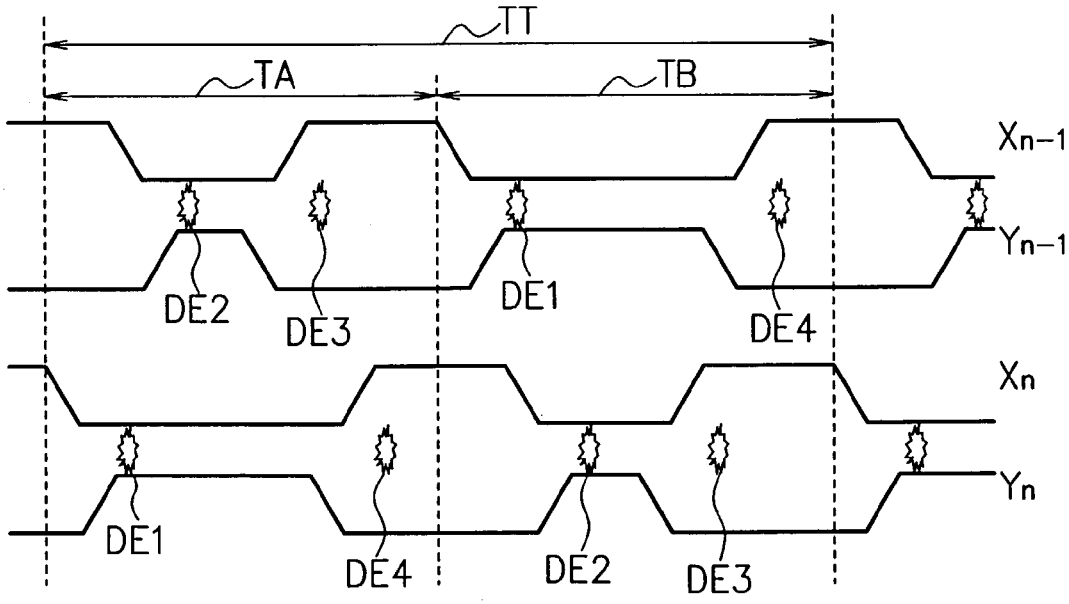
FIG. 13 is a timing chart showing a driving method during a sustain period of a progressive method plasma display according to a fifth embodiment of the present invention.

FIG. 13 is a timing chart showing a driving method during the sustain period Ts of a progressive method plasma display according to a fifth embodiment of the present invention. A period TA is the same as the period TT in FIG. 12. In a period TB subsequent thereto, in comparison with the period TA, the voltage to the sustain electrodes Xn and the like on the even-numbered rows is exchanged with the voltage to the sustain electrodes Xn−1 and the like on the odd-numbered rows, and the voltage to the scan electrodes Yn and the like on the even-numbered rows is exchanged with the voltage to the scan electrodes Yn−1 and the like on the odd-numbered rows. The waveforms during the period TT composed of a set of the period TA and the period TB are repeated as one cycle to form the voltage waveforms of sustain discharges. This embodiment can also prevent, as in the fourth embodiment, the negative charges from diffusing to eliminate error display.

In the fourth embodiment (FIG. 12), in all the periods TT, the discharges DE2 and DE3 are performed between the electrodes Xn−1 and Yn−1 at short intervals, while the discharges DE1 and DE4 are performed between the electrodes Xn and Yn at long intervals. In other words, there occurs unevenness between the intervals of discharges between the electrodes Xn−1 and Yn−1 and the intervals of discharges between the electrodes Xn and Yn. In contrast to this, in the fifth embodiment (FIG. 13), the periods TA and TB are alternately performed to eliminate the unevenness between the intervals of discharges between the electrodes Xn−1 and Yn−1 and the intervals of discharges between the electrodes Xn and Yn.

Sixth Embodiment

Figure 14:
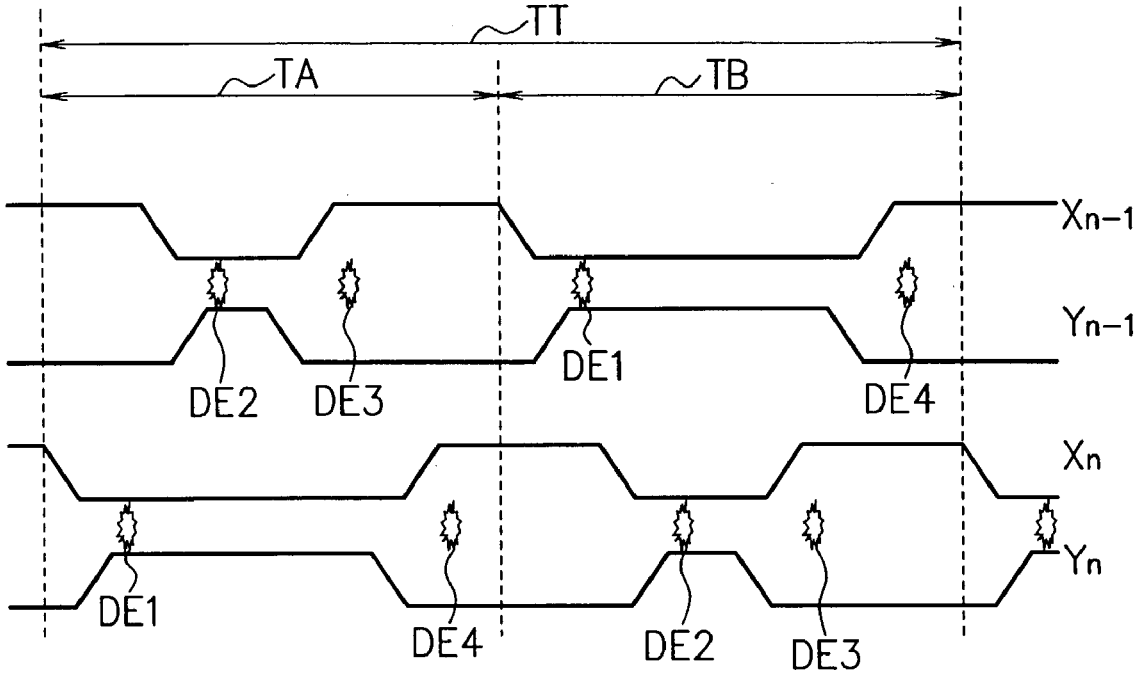
FIG. 14 is a timing chart showing a driving method during a sustain period of a progressive method plasma display according to a sixth embodiment of the present invention.

FIG. 14 is a timing chart showing a driving method during the sustain period Ts of a progressive method plasma display according to a sixth embodiment of the present invention. In the sixth embodiment, as in the fifth embodiment (FIG. 13), the period TT composed of the periods TA and TB is one cycle. While the voltage waveforms in the second embodiment (FIG. 8) are applied to the fifth embodiment, the voltage waveforms in the third embodiment (FIG. 9) are applied to the sixth embodiment. This embodiment also provides the same effects as those in the above-described embodiments.

Seventh Embodiment

Figure 15:
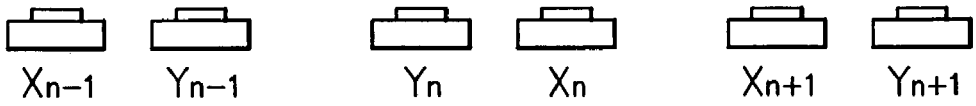
FIG. 15 is a diagram showing an arrangement of electrodes of a progressive method plasma display according to a seventh embodiment of the present invention.

FIG. 15 shows an arrangement of electrodes of a progressive method plasma display according to a seventh embodiment of the present invention. In the above first to sixth embodiments, the description has been made on the case in which the sustain electrodes and the scan electrodes constituting the display cells are alternately provided. More specifically, the scan electrodes to be scanned for application of an address selection voltage and the sustain electrodes to which the address selection voltage is not applied are alternately provided. In the seventh embodiment, two adjacent scan electrodes Yn+1, Yn and the like and two adjacent sustain electrodes Xn, Xn+1 and the like are alternately provided.

Eighth Embodiment

Figure 16:
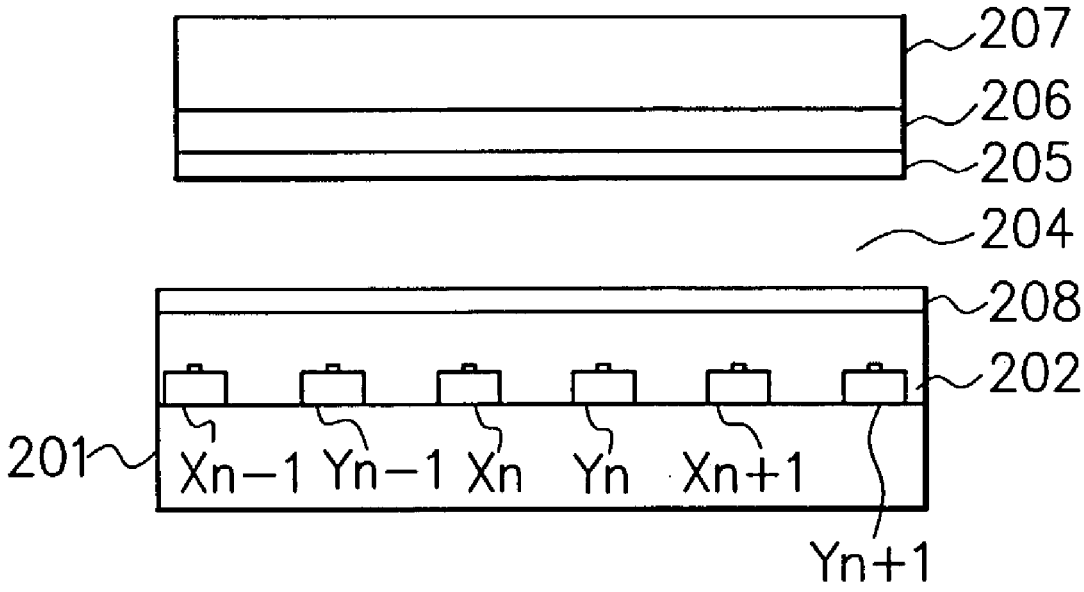
FIG. 16 is a cross-sectional view of an ALIS method plasma display according to an eighth embodiment of the present invention.

FIG. 16 is a cross-sectional view of an ALIS method plasma display according to an eighth embodiment of the present invention. This configuration is basically the same as that of the progressive method plasma display in FIG. 2. In the ALIS method, however, all of intervals between the electrodes Xn−1, Yn−1, Xn, Yn, Xn+1, and Yn+1 are the same with no light shield 203 provided. Gaps between the electrodes Xn−1 and Yn−1, between the electrodes Xn and Yn, and between the electrodes Xn+1 and Yn+1 are first slits respectively, and gaps between the electrodes Yn−1 and Xn and between the electrodes Yn and Xn+1 are second slits respectively. In the ALIS method, sustain discharges in the first slits are performed in a first frame FR in FIG. 27 as an odd field, and sustain discharges in the second slits are performed in a second frame FR subsequent thereto as an even field. These odd and even fields are repeatedly performed. Each of the electrodes can perform sustain discharges with respect to adjacent electrodes on both sides. The ALIS method has the number of display lines (rows) twice that of the progressive method, and thus enables high resolution.

Figure 17A:
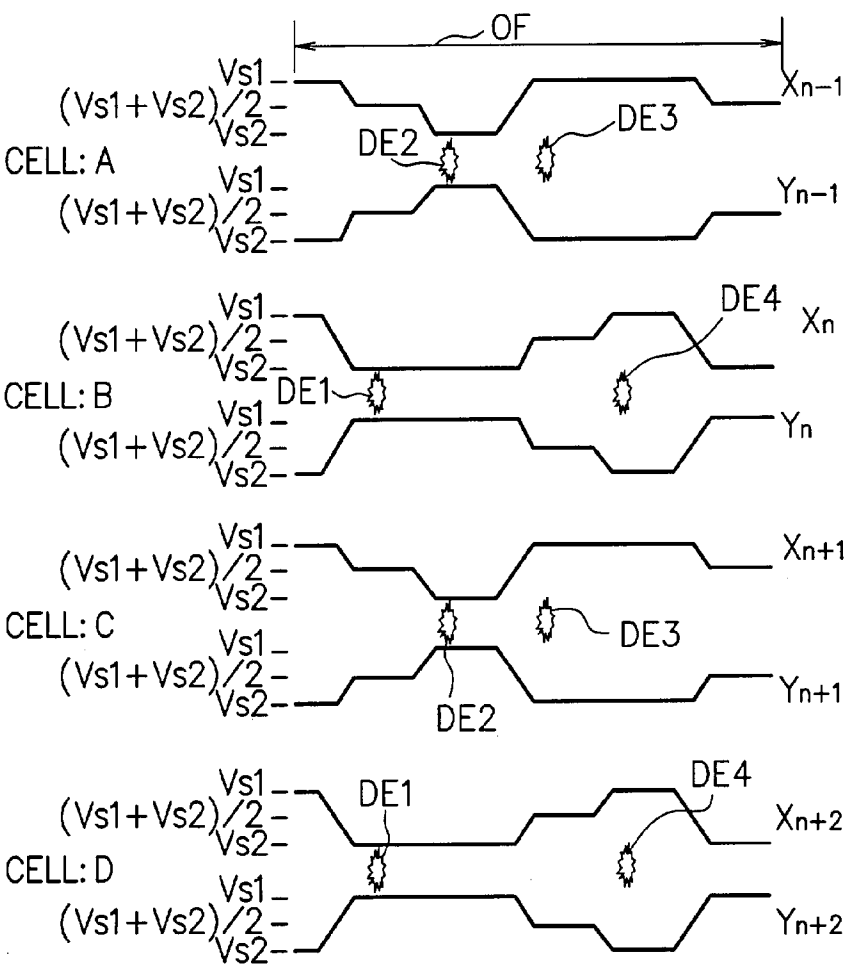
FIGS. 17A and 17B are timing charts each showing a driving method during a sustain period of an ALIS method plasma display according to the eighth embodiment.
Figure 17B:
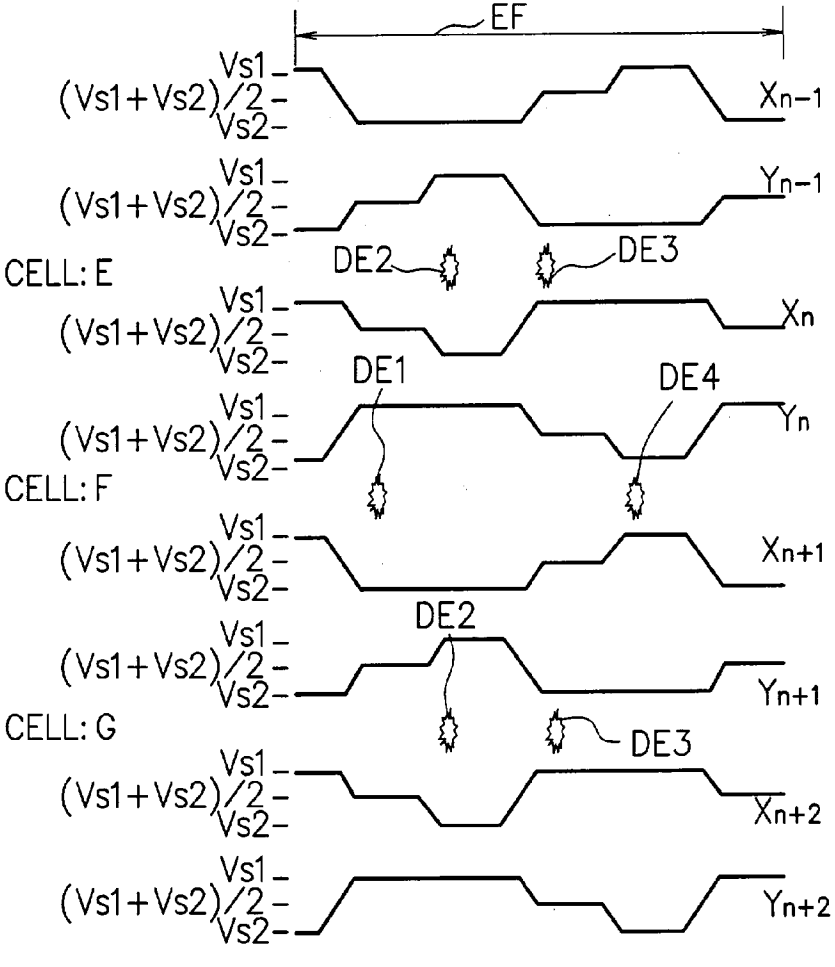

FIGS. 17A and 17B are timing charts each showing a driving method during the sustain period Ts of the ALIS method plasma display according to this embodiment, in which the first embodiment (FIG. 3) is applied to the ALIS method. FIG. 17A shows the voltage waveforms of sustain discharges in an odd field OF, and FIG. 17B shows the voltage waveforms of sustain discharges in an even field EF. The voltage waveforms in the odd field OF are the same as those in the first embodiment (FIG. 3). In the even field EF, in comparison with the odd field OF, the voltage to the sustain electrodes Xn−1, Xn+1, and the like on the odd-numbered rows is exchanged with the voltage to the sustain electrodes Xn, Xn+2, and the like on the even-numbered rows.

Ninth Embodiment

Figures 18A, 18B:
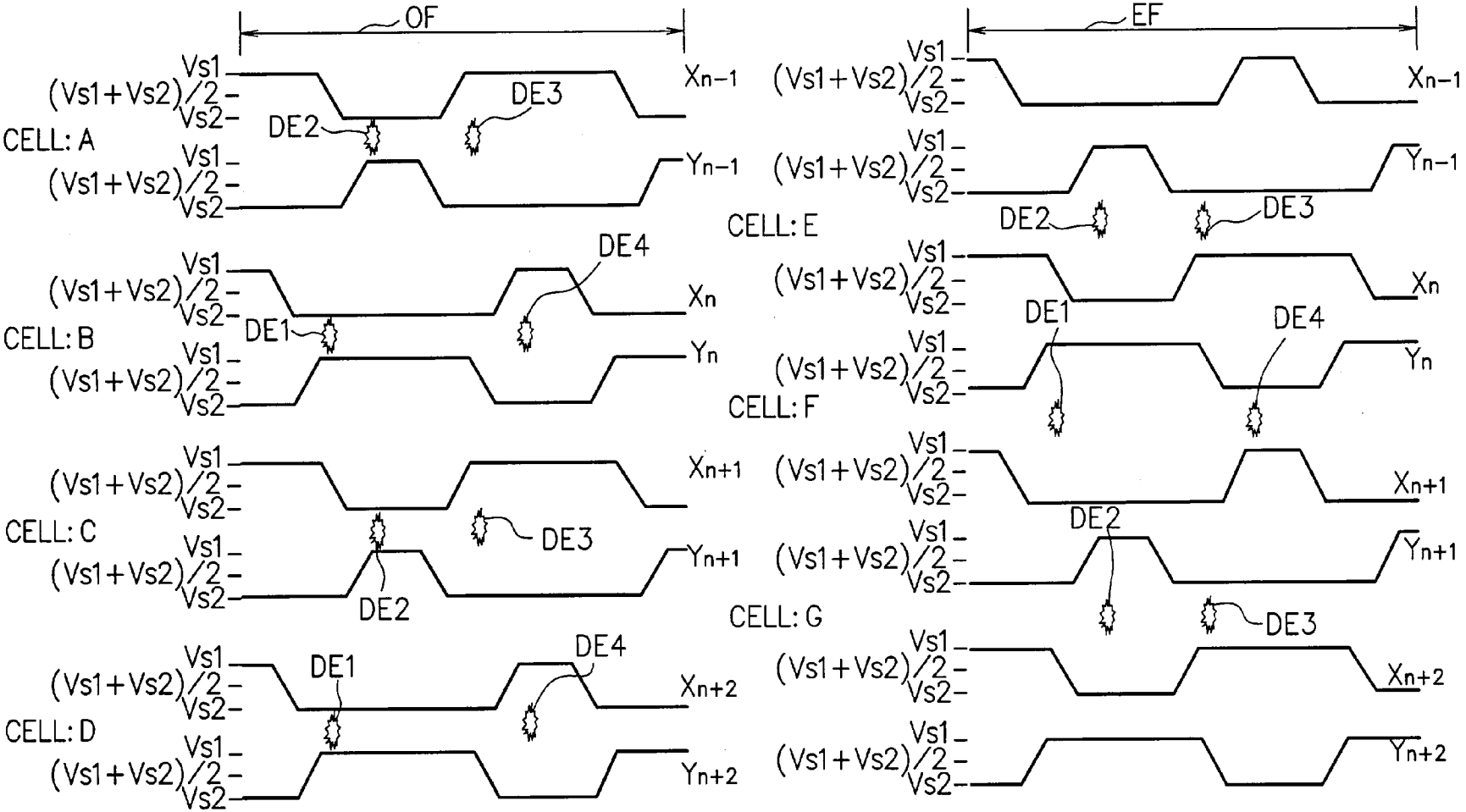
FIGS. 18A and 18B are timing charts each showing a driving method during a sustain period of an ALIS method plasma display according to a ninth embodiment of the present invention.

FIGS. 18A and 18B are timing charts each showing a driving method during the sustain period Ts of an ALIS method plasma display according to a ninth embodiment of the present invention, in which the second embodiment (FIG. 8) is applied to the ALIS method. FIG. 18A shows the voltage waveforms of sustain discharges in an odd field OF, and FIG. 18B shows the voltage waveforms of sustain discharges in an even field EF. The voltage waveforms in the odd field OF are the same as those in the second embodiment (FIG. 8). In the even field EF, in comparison with the odd field OF, the voltage to the sustain electrodes Xn−1, Xn+1, and the like on the odd-numbered rows is exchanged with the voltage to the sustain electrodes Xn, Xn+2, and the like on the even-numbered rows.

Tenth Embodiment

Figures 19A, 19B:
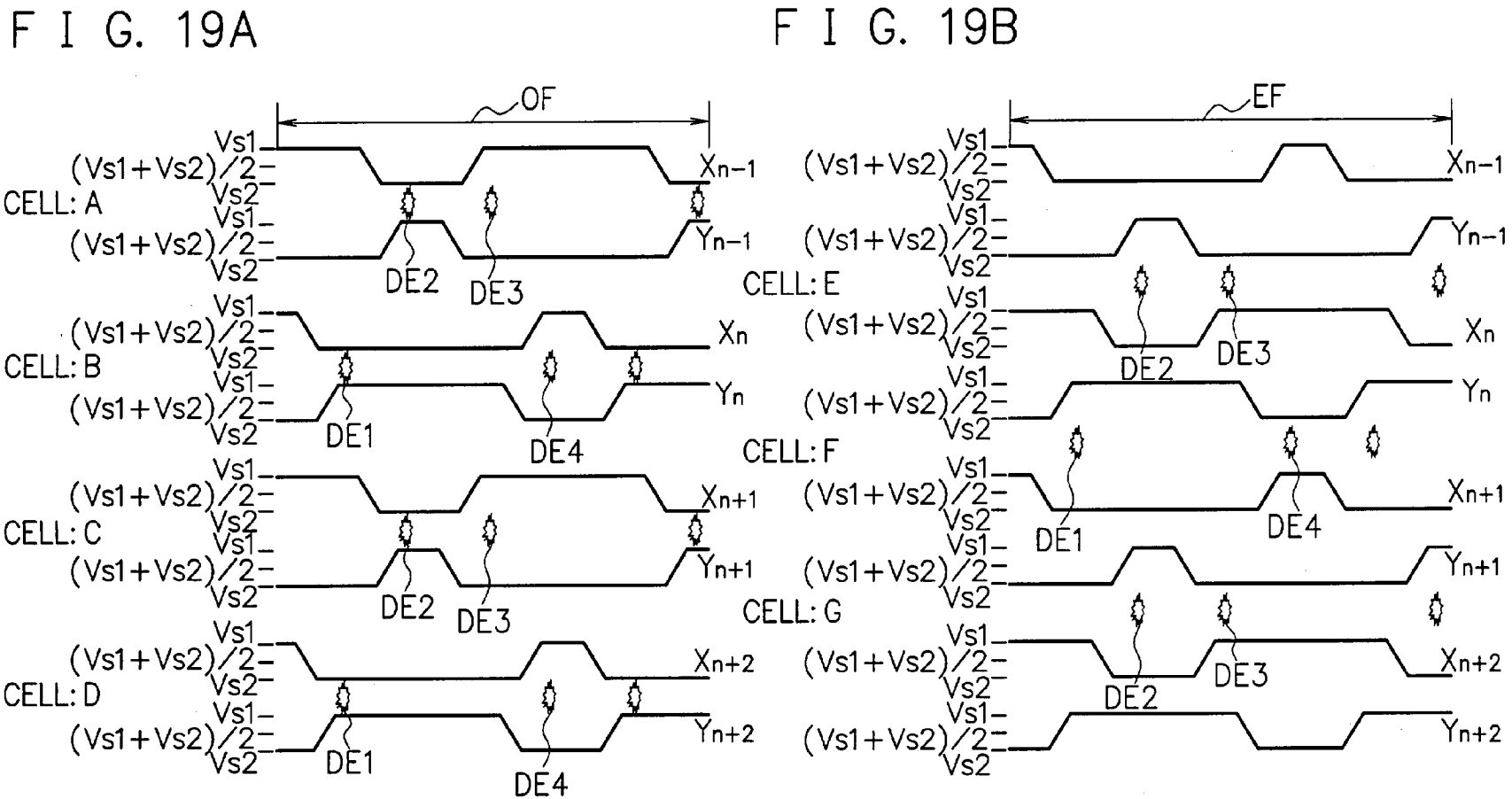
FIGS. 19A and 19B are timing charts each showing a driving method during a sustain period of an ALIS method plasma display according to a tenth embodiment of the present invention.

FIGS. 19A and 19B are timing charts each showing a driving method during the sustain period Ts of an ALIS method plasma display according to a tenth embodiment of the present invention, in which the third embodiment (FIG. 9) is applied to the ALIS method. FIG. 19A shows the voltage waveforms of sustain discharges in an odd field OF, and FIG. 19B shows the voltage waveforms of sustain discharges in an even field EF. The voltage waveforms in the odd field OF are the same as those in the third embodiment (FIG. 9). In the even field EF, in comparison with the odd field OF, the voltage to the sustain electrodes Xn−1, Xn+1, and the like on the odd-numbered rows is exchanged with the voltage to the sustain electrodes Xn, Xn+2, and the like on the even-numbered rows.

Eleventh Embodiment

Figure 20A:
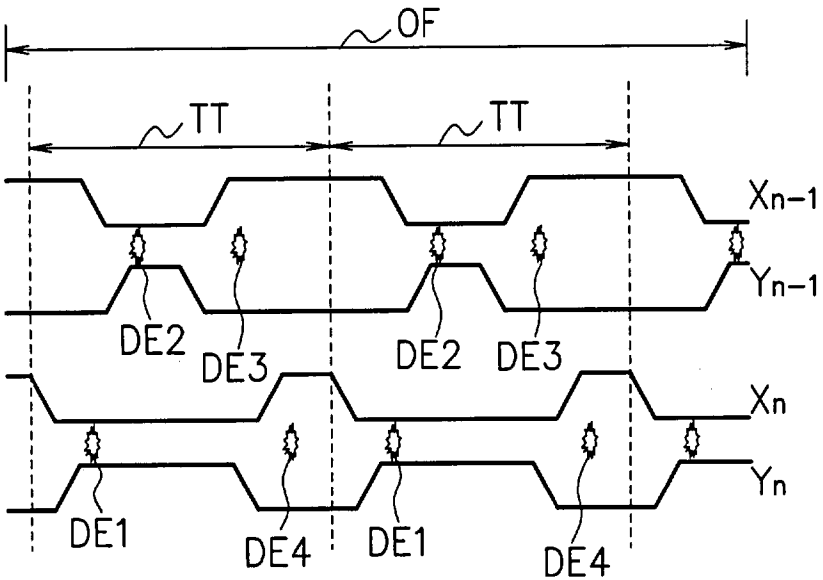
FIGS. 20A and 20B are timing charts each showing a driving method during a sustain period of an ALIS method plasma display according to an eleventh embodiment of the present invention.
Figure 20B:
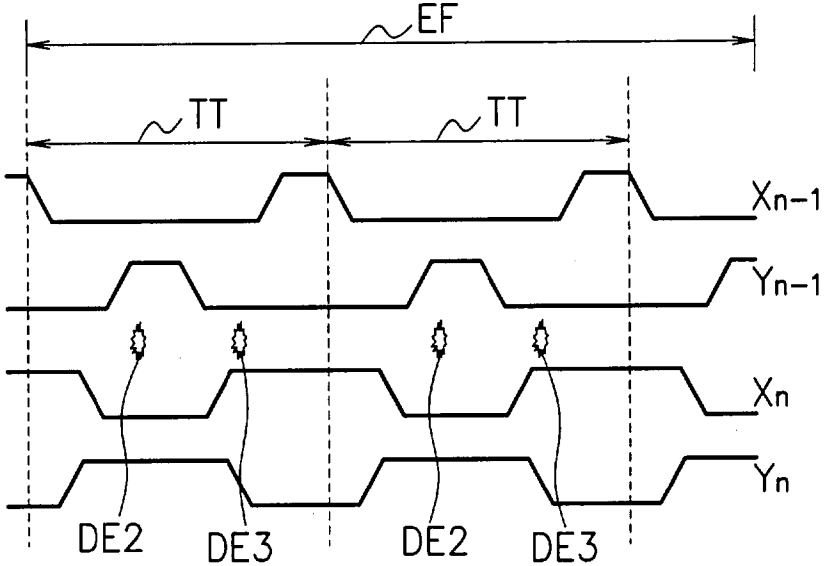

FIGS. 20A and 20B are timing charts each showing a driving method during the sustain period Ts of an ALIS method plasma display according to an eleventh embodiment of the present invention, in which the fourth embodiment (FIG. 12) is applied to the ALIS method. FIG. 20A shows the voltage waveforms of sustain discharges in an odd field OF, and FIG. 20B shows the voltage waveforms of sustain discharges in an even field EF. The voltage waveforms in the odd field OF are the same as those in the fourth embodiment (FIG. 12). In the even field EF, in comparison with the odd field OF, the voltage to the sustain electrodes Xn−1 and the like on the odd-numbered rows is exchanged with the voltage to the sustain electrodes Xn and the like on the even-numbered rows.

Twelfth Embodiment

Figure 21A:
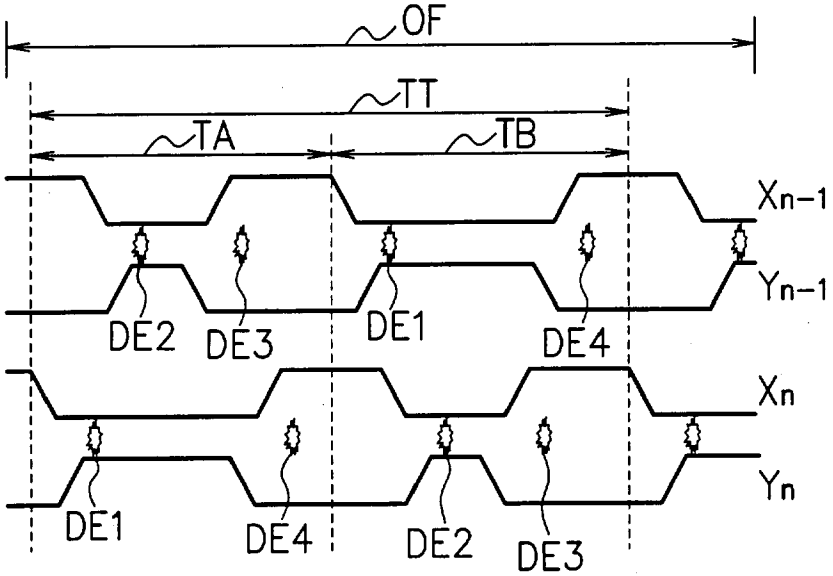
FIGS. 21A and 21B are timing charts each showing a driving method during a sustain period of an ALIS method plasma display according to a twelfth embodiment of the present invention.
Figure 21B:
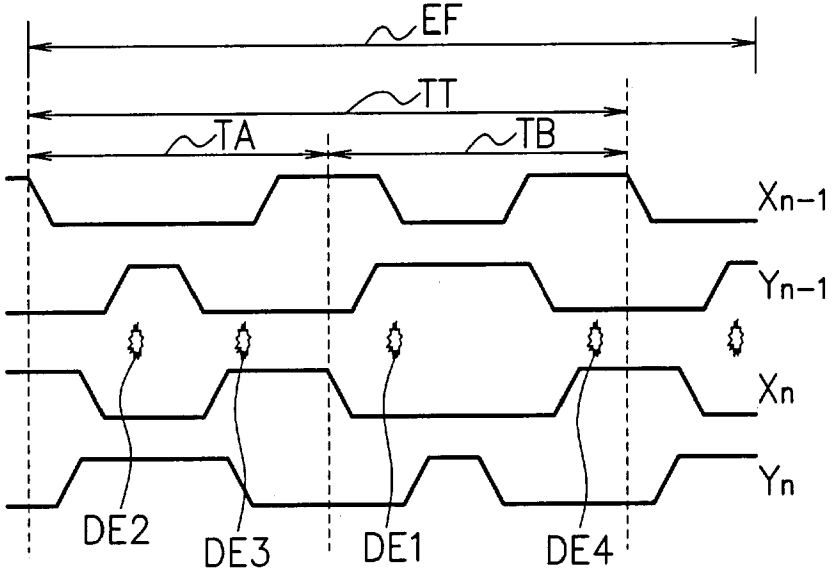

FIGS. 21A and 21B are timing charts each showing a driving method during the sustain period Ts of an ALIS method plasma display according to a twelfth embodiment of the present invention, in which the fifth embodiment (FIG. 13) is applied to the ALIS method. FIG. 21A shows the voltage waveforms of sustain discharges in an odd field OF, and FIG. 21B shows the voltage waveforms of sustain discharges in an even field EF. The voltage waveforms in the odd field OF are the same as those in the fifth embodiment (FIG. 13). In the even field EF, in comparison with the odd field OF, the voltage to the sustain electrodes Xn−1 and the like on the odd-numbered rows is exchanged with the voltage to the sustain electrodes Xn and the like on the even-numbered rows.

Thirteenth Embodiment

Figure 22A:
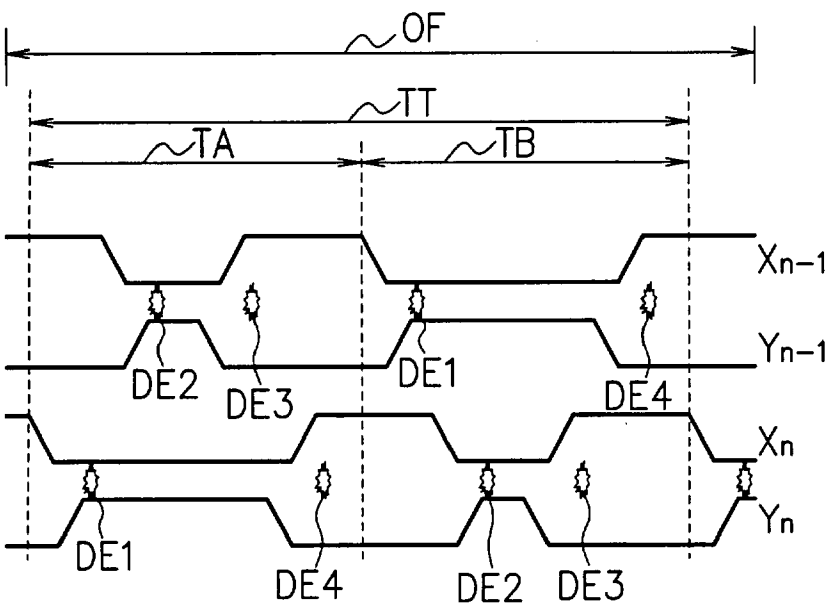
FIGS. 22A and 22B are timing charts each showing a driving method during a sustain period of an ALIS method plasma display according to a thirteenth embodiment of the present invention.
Figure 22B:
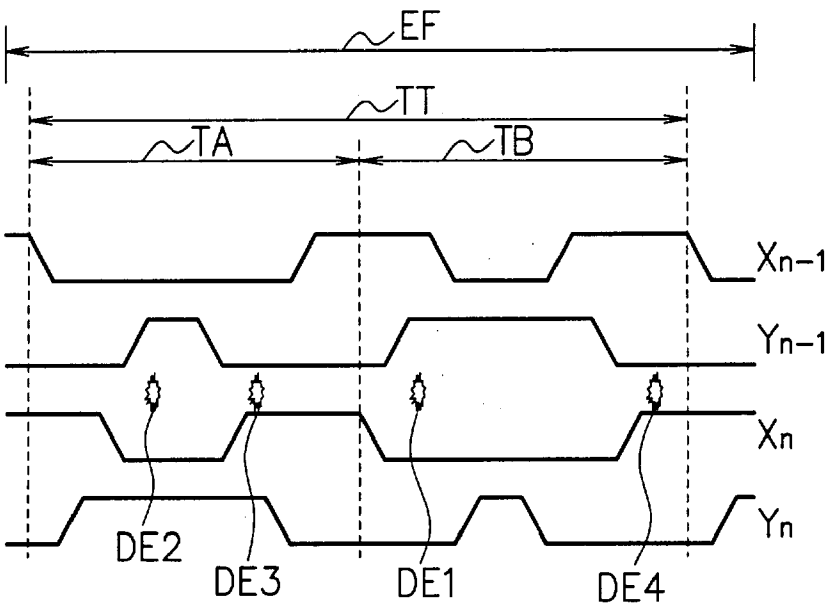

FIGS. 22A and 22B are timing charts each showing a driving method during the sustain period Ts of an ALIS method plasma display according to a thirteenth embodiment of the present invention, in which the sixth embodiment (FIG. 14) is applied to the ALIS method. FIG. 22A shows the voltage waveforms of sustain discharges in an odd field OF, and FIG. 22B shows the voltage waveforms of sustain discharges in an even field EF. The voltage waveforms in the odd field OF are the same as those in the sixth embodiment (FIG. 14). In the even field EF, in comparison with the odd field OF, the voltage to the sustain electrodes Xn−1 and the like on the odd-numbered rows is exchanged with the voltage to the sustain electrodes Xn and the like on the even-numbered rows.

In the ALIS method, as shown in FIG. 16, the intervals of the first slits and second slits are the same and thus likely to cause error display. According to the eighth to thirteenth embodiments, even by the ALIS method, each display cell can perform stable sustain discharges without receiving adverse effects from adjacent electrodes.

Note that while the description has been made, in the eighth to thirteenth embodiments, on the case in which the voltage to the sustain electrodes on the odd-numbered rows is exchanged with the voltage to the sustain electrodes on the even-numbered rows between the odd field and the even field, the voltages to the scan electrodes may be exchanged with each other in place of the sustain electrodes.

Fourteenth Embodiment

Figure 23A:
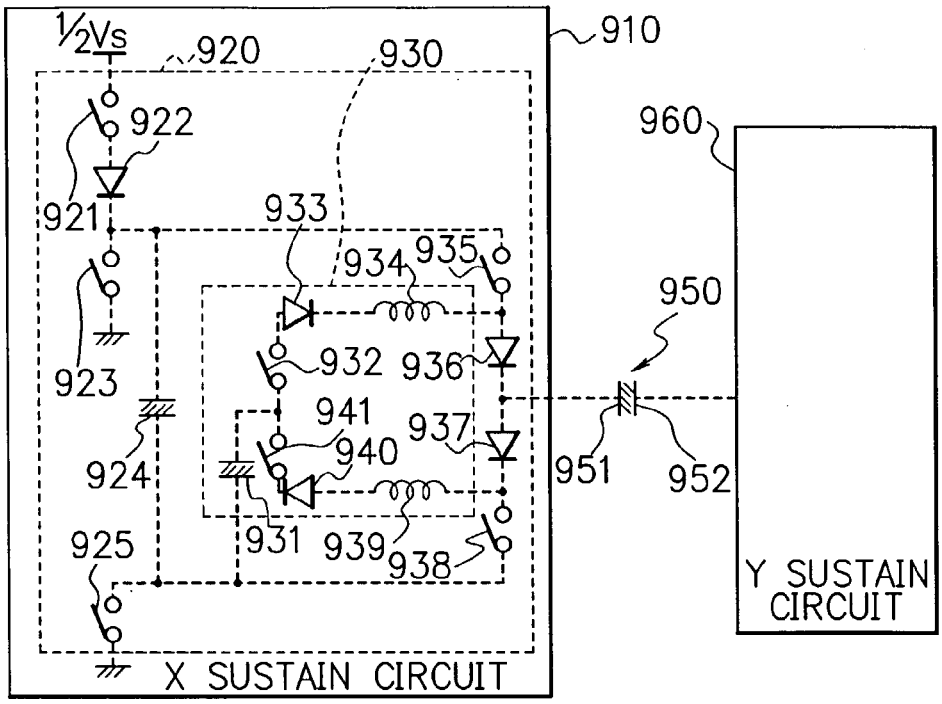
FIGS. 23A and 23B are circuit diagrams of sustain electrode sustain circuits and scan electrode sustain circuits according to a fourteenth and a fifteenth embodiment of the present invention.

FIG. 23A shows the configuration of a sustain electrode sustain circuit 910 and a scan electrode sustain circuit 960 according to a fourteenth embodiment of the present invention. The sustain electrode sustain circuit 910, corresponding to the sustain electrode sustain circuits 103*a* and 103*b* in FIG. 1, is connected to a sustain electrode 951. The scan electrode sustain circuit 960, corresponding to the scan electrode sustain circuits 104*a* and 104*b* in FIG. 1, is connected to a scan electrode 952. A capacitor 950 is constituted of the sustain electrode 951, the scan electrode 952, and a dielectric therebetween. The sustain electrode sustain circuit 910 has a TERES (Technology of Reciprocal Sustainer) circuit 920 and a power recovery circuit 930.

First, the description will be made on the configuration of the TERES circuit 920. A diode 922 has an anode connected to a first potential (for example, Vs1=Vs/2[V]) via a switch 921 and a cathode connected to a second potential (for example, the ground) lower than the first potential via a switch 923. A capacitor 924 has one end connected to the cathode of the diode 922 and the other end connected to the second potential via a switch 925. A diode 936 has an anode connected to the cathode of the diode 922 via a switch 935 and a cathode connected to the sustain electrode 951. A diode 937 has an anode connected to the sustain electrode 951 and a cathode connected to the aforementioned other end of the capacitor 924 via a switch 938.

Figure 24A:
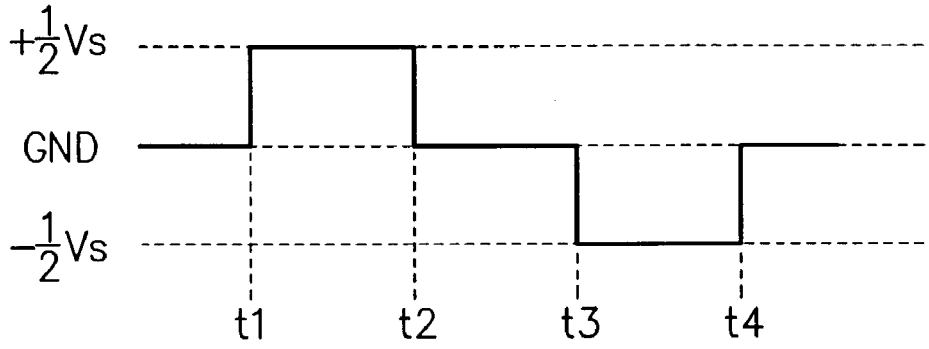
FIGS. 24A to 24C are diagrams showing voltage waveforms of sustain discharges.

Next, the description will be made on the operation of the TERES circuit 920 without the power recovery circuit 930. The following description is made on the case in which a sustain discharge voltage shown in FIG. 24A is applied to the sustain electrode Xn. The above-described anode voltage Vs1 is, for example, Vs/2[V], and the cathode voltage Vs2 is, for example, −Vs/2[V]. At time t1, the switches 921, 925, and 935 are closed, and the switches 923 and 938 are opened. Then, the potential of Vs/2 is applied to the sustain electrode 951 via the switches 921 and 935. Besides, the electrode on the upper side (hereafter referred to as the upper end) in the drawing is connected to Vs/2, and the electrode on the lower side (hereafter referred to as the lower end) in the drawing is connected to the ground so that the capacitor 924 is charged. In this event, the charges on the capacitor 924 are discharged via the switch 935 and the diode 936 to the capacitor 950.

Subsequently, at time t2, the switches 925 and 938 are closed, and the switches 923 and 935 are opened. Then, the ground potential is applied to the sustain electrode 951 via the switches 925 and 938.

Subsequently, at time t3, the switches 923 and 938 are closed, and the switches 921, 925, and 935 are opened. Then, the capacitor 924 has the upper end at the ground and the lower end at −Vs/2. The cathode potential of −Vs/2 is applied to the sustain electrode 951 via the switch 938.

Subsequently, at time t4, the switches 923 and 935 are closed, and the switches 921, 925, and 938 are opened. Then, the ground potential is applied to the sustain electrode 951 via the switches 923 and 935.

As described above, the use of the TERES circuit 920 enables generation of the anode potential Vs1, the cathode potential Vs2, and an intermediate potential (Vs1+Vs2)/2 with a simple circuit configuration.

Next, the description will be made on the configuration of the power recovery circuit 930. A capacitor 931 has a lower end connected to the lower end of the capacitor 924. A diode 933 has an anode connected to an upper end of the capacitor 931 via a switch 932 and a cathode connected to the anode of the diode 936 via a coil 934. A diode 940 has an anode connected to the cathode of the diode 937 via a coil 939 and a cathode connected to the upper end of the capacitor 931 via a switch 941.

Figure 24B:
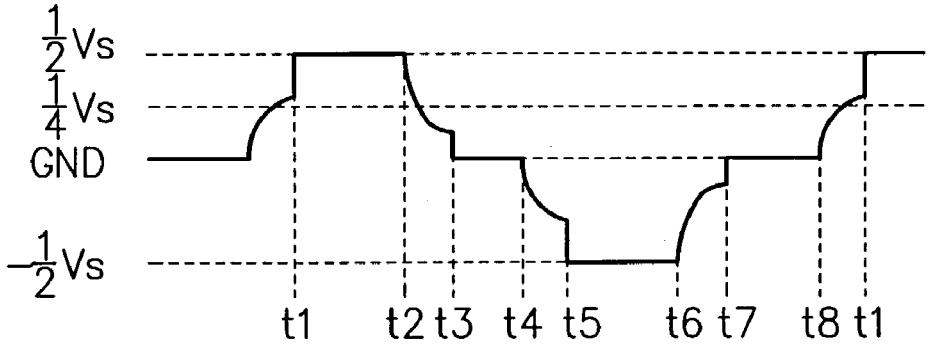

Next, the description will be made on the operation of the power recovery circuit 930 with reference to FIG. 24B. First, at time t1, the switches 921, 925, and 935 are closed, and the other switches are opened. Note that while the switch 935 is closed here, the switch 932 is closed before time t1 and thus may be kept closed also from time t1 to time t2. Then, the potential of Vs/2 is applied to the sustain electrode 951 from the power supply and the capacitor 924 via the switches 921 and 935. The capacitor 924 is charged to the potential of Vs/2 from the power supply as well as discharges it to the capacitor 950 of the sustain electrode 951.

Subsequently, at time t2, the switch 935 is opened, and the switch 941 is closed. Then, the charges on the sustain electrode 951 are supplied to the upper end of the capacitor 931 via the coil 939. The lower end of the capacitor 931 is connected to the second potential (GND) via the switch 925.

Due to an LC resonance of the coil 939 and the capacitor (panel capacitance) 950, the capacitor 931 is charged so that power is recovered. This lowers the potential of the sustain electrode 951 to near Vs/4. Further, the diodes 940 and 937 remove the resonance, and the coil 939 can stabilize the potential of the sustain electrode 951 at near Vs/4.

Subsequently, at time t3, the switch 938 is closed. Then, the potential of the sustain electrode 951 becomes the ground.

Subsequently, at time t4, the switches 941 and 938 are opened, thereafter the switches 921 and 925 are opened, and the switch 923 is closed. Subsequently, the switch 941 is closed. The sustain electrode 951 is connected to the ground via the diode 937, the coil 939, the diode 940, the switch 941, the capacitor 931, the capacitor 924, and the switch 923. Then, due to the LC resonance, the potential of the sustain electrode 951 lowers to near −Vs/4.

Subsequently, at time t5, the switch 938 is closed. The potential of the sustain electrode 951 lowers to −Vs/2.

Subsequently, at time t6, the switches 941 and 938 are opened, and the switch 932 is closed. Due to the LC resonance, the potential of the sustain electrode 951 lowers to near −Vs/4.

Subsequently, at time t7, when the switch 935 is closed, the potential rises to the ground. Thereafter, the switches 932 and 935 are opened, the switch 923 is opened, the switches 921 and 925 are closed, and the switch 938 is closed.

Subsequently, at time t8, the switch 938 is opened, and the switch 932 is closed. The potential of the sustain electrode 951 rises to near Vs/4. Thereafter, a cycle of the above-described time t1 to time t8 can be repeated.

The configuration of the scan electrode sustain circuit 960 is similar to that of the sustain electrode sustain circuit 910. The use of the power recovery circuit 930 can improve the energy efficiency to reduce the power consumption.

Fifteenth Embodiment

Figure 23B:
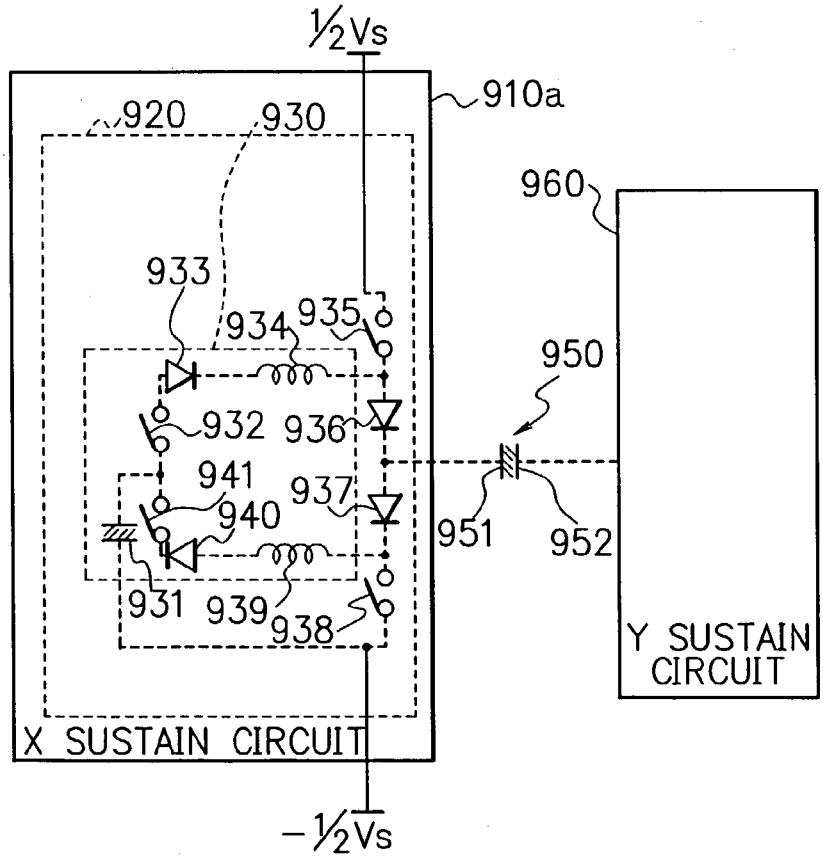

FIG. 23B shows the configuration of a sustain electrode sustain circuit 910*a* according to a fifteenth embodiment of the present invention. The description will be made on the point of the sustain electrode sustain circuit 910*a* differing from the circuit 910 in FIG. 23A. The sustain electrode sustain circuit 910*a* is made by omitting the switches 921, 923, and 925, the diode 922, and the capacitor 924 in FIG. 23A, connecting the switch 935 between the anode of the diode 936 and the power supply of Vs/2, and connecting the switch 938 between the cathode of the diode 937 and the power supply of Vs/2.

Figure 24C:
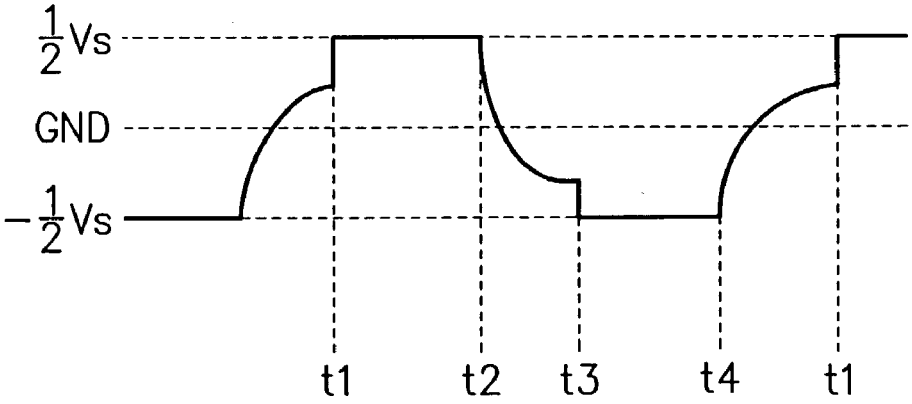
Figure 25:
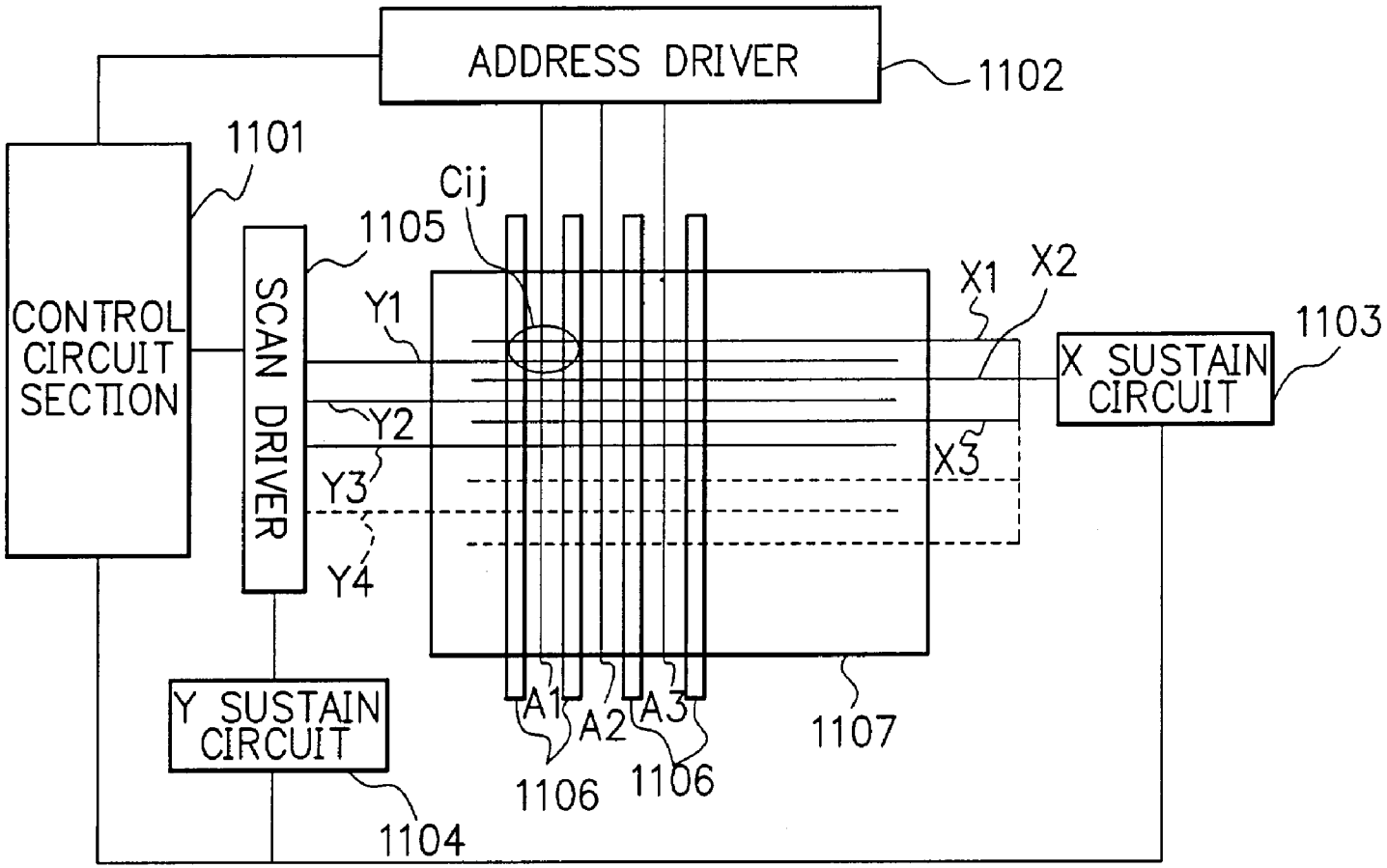
FIG. 25 is a diagram showing the configuration of a plasma display device.

Next, the description will be made on the operation of the sustain electrode sustain circuit 910*a* with reference to FIG. 24C. First, at time t1, the switch 935 is closed, and the other switches are opened. Note that while the switch 935 is closed here, the switch 932 is closed before time t1 and thus may be kept closed also from time t1 to time t2. The sustain electrode 951 is connected to the power supply of Vs/2 and sustains the potential of Vs/2.

Subsequently, at time t2, the switch 935 is opened, and the switch 941 is closed. The sustain electrode 951 is connected to the capacitor 931 via the switch 941, and lowers in potential to near −Vs/4 due to an LC resonance.

Subsequently, at time t3, the switch 938 is closed. The sustain electrode 951 is connected to the power supply of −Vs/2 and sustains the potential of −Vs/2.

Subsequently, at time t4, the switches 941 and 938 are opened, and the switch 932 is closed. The sustain electrode 951 is connected to the capacitor 931 via the switch 932 and lowers in potential to near Vs/4 due to the LC resonance. Thereafter, a cycle of the above-described time t1 to time t4 can be repeated.

As described above, during performance of the sustain discharges between first and second display electrodes, the applied voltage to third electrodes adjacent to the first and second electrodes performing the sustain discharges and the polarity of wall charges formed on the third electrodes are controlled, thereby preventing the charges on the first and second electrodes from diffusing to the adjacent electrodes to eliminate error display.

With an increase in resolution of plasma displays, the distance between electrodes becomes short and likely to cause interference between adjacent display cells. In the above-described embodiments, the interference between them can be suppressed, and stable operation can be realized by increased margin of operating voltage.

The present embodiments are to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

As has been described, during performance of the sustain discharges between first and second display electrodes, the applied voltage to third electrodes adjacent to the first and second electrodes performing the sustain discharges and the polarity of wall charges formed on the third electrodes are controlled, thereby preventing the charges on the first and second electrodes from diffusing to the adjacent electrodes to eliminate error display.

What is claimed is:

1. A driving circuit of a plasma display panel in which a display cell including a first electrode and a second electrode is selected to light up, for applying a first voltage Vs1 to said first electrode and a second voltage Vs2 to said second electrode adjacent to said first electrode to cause a sustain discharge between said first and second electrodes, said driving circuit comprising:

a sustain discharge circuit for generating a sustain discharge voltage such that during the sustain discharge between said first and second electrodes, an applied voltage Vc to a third electrode adjacent to said first electrode opposite to said second electrode falls within a range $Vs2 \leqq Vc < Vs1$, and in this case, when a display cell including said third electrode is selected to light up, the polarity of a wall charge formed on said third electrode becomes positive.

2. The driving circuit of a plasma display panel according to claim 1, wherein, in said plasma display panel, a plurality of discharge electrodes including said first to third electrodes are provided in sequence, and wherein, in said plurality of discharge electrodes, a sustain discharge is caused between two of said discharge electrodes, one of said two discharge electrodes is a first discharge electrode to be scanned for application of a lighting selection voltage, another is a second discharge electrode to which the lighting selection voltage is not applied, and said first discharge electrode and said second discharge electrode are alternately provided.

3. The driving circuit of a plasma display panel according to claim 1, wherein, in said plasma display panel, a plurality of discharge electrodes including said first to third electrodes are provided in sequence, and wherein, in said plurality of discharge electrodes, a sustain discharge is caused between two of said discharge electrodes, one of said two discharge electrodes is a first discharge electrode to be scanned for application of a lighting selection voltage, another is a second discharge electrode to which the lighting selection voltage is not applied, and two adjacent first discharge electrodes and two adjacent second discharge electrodes are alternately provided.

4. The driving circuit of a plasma display panel according to claim 1, wherein, in said plasma display panel, a plurality of discharge electrodes including said first to third electrodes are provided in sequence, and said discharge electrode is capable of performing a sustain discharge only with an adjacent discharge electrode to one side.

5. The driving circuit of a plasma display panel according to claim 1, wherein, in said plasma display panel, a plurality of discharge electrodes including said first to third electrodes are provided in sequence, and said discharge electrode is capable of performing sustain discharges with adjacent discharge electrodes to both sides.

6. The driving circuit of a plasma display panel according to claim 1, wherein said sustain discharge circuit comprises:

a first diode having an anode connected to a first potential via a switch and a cathode connected to a second potential lower than said first potential via a switch;

a first capacitor having one end connected to the cathode of said first diode and another end connected to said second potential via a switch;

a second diode having an anode connected to the cathode of said first diode via a switch, and a cathode connected to said first or second electrode; and a third diode having an anode connected to said first or second electrode and a cathode connected to said other end of said first capacitor via a switch.

7. A driving circuit of a plasma display panel in which a display cell including a first electrode and a second electrode is selected to light up, for applying a first voltage Vs1 to said first electrode and a second voltage Vs2 to said second electrode adjacent to said first electrode to cause a sustain discharge between said first and second electrodes, said driving circuit comprising:

a sustain discharge circuit for generating a sustain discharge voltage such that during the sustain discharge between said first and second electrodes, an applied voltage Vd to a third electrode adjacent to said second electrode opposite to said first electrode falls within a range $Vs2 \leqq Vd < Vs1$, and in this case, when a display cell including said third electrode is selected to light up, the polarity of a wall charge formed on said third electrode becomes positive.

8. A driving circuit of a plasma display panel in which a display cell including a first electrode and a second electrode is selected to light up, for applying a first voltage Vs1 to said first electrode and a second voltage Vs2 to said second electrode adjacent to said first electrode to cause a sustain discharge between said first and second electrodes, said driving circuit comprising:

a sustain discharge circuit for generating a sustain discharge voltage such that during the sustain discharge between said first and second electrodes, an applied voltage Vc to a third electrode adjacent to said first electrode opposite to said second electrode falls within a range $Vs2 < Vc < Vs1$, and in this case, when a display cell including said third electrode is selected to light up, the polarity of a wall charge formed on said third electrode becomes negative.

9. A driving circuit of a plasma display panel in which a display cell including a first electrode and a second electrode is selected to light up, for applying a first voltage Vs1 to said first electrode and a second voltage Vs2 to said second electrode adjacent to said first electrode to cause a sustain discharge between said first and second electrodes, said driving circuit comprising:

a sustain discharge circuit for generating a sustain discharge voltage such that during the sustain discharge between said first and second electrodes, an applied voltage Vc to a third electrode adjacent to said first electrode opposite to said second electrode falls within a range $Vc = Vs1$ within first 500 ns and thereafter $Vs2 < Vc < Vs1$, and in this case, when a display cell including said third electrode is selected to light up, the polarity of a wall charge formed on said third electrode becomes negative.

10. A driving circuit of a plasma display panel in which a first to a six electrode are adjacent in order, comprising:

a sustain discharge circuit for generating a sustain discharge voltage such that when a second voltage Vs2 is applied to said third electrode, and a first voltage Vs1 is applied to said fourth electrode to cause a sustain discharge between said third and fourth electrodes, an applied voltage V2 to said second electrode falls within a range $Vs2 \leqq V2 < Vs1$, and, in this case, when a display cell including said first and second electrodes is selected to light up, the polarity of a wall charge formed on said second electrode becomes positive, and an applied voltage V5 to said fifth electrode falls within a range $Vs2 < V5 < Vs1$, and, in this case, when a display cell including said fifth and sixth electrodes is selected to light up, the polarity of a wall charge formed on said fifth electrode becomes negative, subsequently, when the second voltage Vs2 is applied to said first electrode, and the first voltage Vs1 is applied to said second electrode to cause a sustain discharge between said first and second electrodes, an applied voltage V3 to said third electrode falls within a range $Vs2 \leqq V3 < Vs1$, and when the second voltage Vs2 is applied to said fifth electrode, and the first voltage Vs1 is applied to said sixth electrode to cause a sustain discharge between said fifth and sixth electrodes, an applied voltage V4 to said fourth electrode falls within a range $Vs2 \leqq V4 \leqq Vs1$, subsequently, when the first voltage Vs1 is applied to said first electrode, and the second voltage Vs2 is applied to said second electrode to cause a sustain discharge between said first and second electrodes, the applied voltage V3 to said third electrode falls within a range $Vs2 \leqq V3 < Vs1$, and when the first voltage Vs1 is applied to said fifth electrode, and the second voltage Vs2 is applied to said sixth electrode to cause a sustain discharge between said fifth and sixth electrodes, the applied voltage V4 to said fourth electrode falls within a range $Vs2 < V4 < Vs1$, and subsequently, when the first voltage Vs1 is applied to said third electrode, and the second voltage Vs2 is applied to said fourth electrode to cause a sustain discharge between said third and fourth electrodes, the applied voltage V2 to said second electrode falls within a range Vs2≦V2<Vs1, and the applied voltage V5 to said fifth electrode falls within a range Vs2≦V5≦Vs1.

11. The driving circuit of a plasma display panel according to claim 10, wherein said sustain discharge circuit generates a sustain discharge voltage of repeating said applied voltages as one cycle.

12. The driving circuit of a plasma display panel according to claim 10, wherein said sustain discharge circuit generates a sustain discharge voltage of repeating, as one cycle, the application of said voltages and thereafter application of a voltage for exchanging the applied voltages to a set of said third and fourth electrodes with the applied voltages to a set of said first and second electrodes to make the applied voltages to the set of said first and second electrodes equal to the applied voltages to said fifth and sixth electrodes.

13. A driving circuit of a plasma display panel in which a first to a six electrode are adjacent in order, comprising:

a sustain discharge circuit for generating a sustain discharge voltage such that when a second voltage Vs2 is applied to said third electrode, and a first voltage Vs1 is applied to said fourth electrode to cause a sustain discharge between said third and fourth electrodes, an applied voltage V2 to said second electrode falls within a range Vs2≦V2<Vs1, and, in this case, when a display cell including said first and second electrodes is selected to light up, the polarity of a wall charge formed on said second electrode becomes positive, and an applied voltage V5 to said fifth electrode falls within a range V5=Vs1 within first 500 ns and thereafter Vs2<VS<Vs1, and, in this case, when a display cell including said fifth and sixth electrodes is selected to light up, the polarity of a wall charge formed on said fifth electrode becomes negative, subsequently, when the second voltage Vs2 is applied to said first electrode, and the first voltage Vs1 is applied to said second electrode to cause a sustain discharge between said first and second electrodes, an applied voltage V3 to said third electrode falls within a range Vs2≦V3<Vs1, and when the second voltage Vs2 is applied to said fifth electrode, and the first voltage Vs1 is applied to said sixth electrode to cause a sustain discharge between said fifth and sixth electrodes, an applied voltage V4 to said fourth electrode falls within a range Vs2≦V4≦Vs1, subsequently, when the first voltage Vs1 is applied to said first electrode, and the second voltage Vs2 is applied to said second electrode to cause a sustain discharge between said first and second electrodes, the applied voltage V3 to said third electrode falls within a range Vs2≦V3<Vs1, and when the first voltage Vs1 is applied to said fifth electrode, and the second voltage Vs2 is applied to said sixth electrode to cause a sustain discharge between said fifth and sixth electrodes, the applied voltage V4 to said fourth electrode falls within a range V4=Vs1 within first 500 ns and thereafter Vs2<V4<Vs1, and subsequently, when the first voltage Vs1 is applied to said third electrode, and the second voltage Vs2 is applied to said fourth electrode to cause a sustain discharge between said third and fourth electrodes, the applied voltage V2 to said second electrode falls within a range Vs2≦V2<Vs1, and the applied voltage VS to said fifth electrode falls within a range Vs2≦V5≦Vs1.

14. The driving circuit of a plasma display panel according to claim 13, wherein said sustain discharge circuit generates a sustain discharge voltage of repeating said applied voltages as one cycle.

15. The driving circuit of a plasma display panel according to claim 13, wherein said sustain discharge circuit generates a sustain discharge voltage of repeating, as one cycle, the application of said voltages and thereafter application of a voltage for exchanging the applied voltages to a set of said third and fourth electrodes with the applied voltages to a set of said first and second electrodes to make the applied voltages to the set of said first and second electrodes equal to the applied voltages to said fifth and sixth electrodes.

16. A driving circuit of a plasma display panel in which a first to a fourth electrode are adjacent in order, comprising:

a sustain discharge circuit for generating a sustain discharge voltage such that when a first voltage Vs1 is applied to said second electrode, and a second voltage Vs2 is applied to said third electrode to cause a sustain discharge between said second and third electrodes, an applied voltage V1 to said first electrode falls within a range Vs2≦V1<Vs1, and, in this case, when a display cell including said first electrode is selected to light up, the polarity of a wall charge formed on said first electrode becomes positive, and an applied voltage V4 to said fourth electrode falls within a range Vs2≦V4≦Vs1, and, in this case, when a display cell including said fourth electrode is selected to light up, the polarity of a wall charge formed on said fourth electrode becomes negative.

17. A driving circuit of a plasma display panel in which a first to a fourth electrode are adjacent in order, comprising:

a sustain discharge circuit for generating a sustain discharge voltage such that when a first voltage Vs1 is applied to said second electrode, and a second voltage Vs2 is applied to said third electrode to cause a sustain discharge between said second and third electrodes, an applied voltage V4 to said fourth electrode falls within a range Vs2≦V4<Vs1, and, in this case, when a display cell including said fourth electrode is selected to light up, the polarity of a wall charge formed on said fourth electrode becomes positive, and an applied voltage V1 to said first electrode falls within a range Vs2<V1<Vs1, and, in this case, when a display cell including said first electrode is selected to light up, the polarity of a wall charge formed on said first electrode becomes negative.

18. A driving circuit of a plasma display panel in which a first to a fourth electrode are adjacent in order, comprising:

a sustain discharge circuit for generating a sustain discharge voltage such that when a first voltage Vs1 is applied to said second electrode, and a second voltage Vs2 is applied to said third electrode to cause a sustain discharge between said second and third electrodes, an applied voltage V4 to said fourth electrode falls within a range Vs2≦V4<Vs1, and, in this case, when a display cell including said fourth electrode is selected to light up, the polarity of a wall charge formed on said fourth electrode becomes positive, and an applied voltage V1 to said first electrode falls within a range V1=Vs1 within first 500 ns and thereafter Vs2<V1<Vs1, and, in this case, when a display cell including said first electrode is selected to light up, the polarity of a wall charge formed on said first electrode becomes negative.

* * * * *

UNITED STATES PATENT AND TRADEMARK OFFICE

CERTIFICATE OF CORRECTION

PATENT NO. : 7,145,526 B2
APPLICATION NO. : 10/440319
DATED : December 5, 2006
INVENTOR(S) : Akihiro Takagi et al.

It is certified that error appears in the above-identified patent and that said Letters Patent is hereby corrected as shown below:

Col. 23, line 37, change "Vs2<Vs<Vs1" to --Vs2<V5<Vs1--

Col. 24, line 2, change "VS" to --V5--

Signed and Sealed this

Tenth Day of April, 2007

JON W. DUDAS
*Director of the United States Patent and Trademark Office*